US012446738B2

(12) United States Patent
Tang

(10) Patent No.: US 12,446,738 B2
(45) Date of Patent: Oct. 21, 2025

(54) SEAT APPARATUS, MODULAR SEAT AND ROTATION MECHANISM

(71) Applicant: STUDIO DOOZY LIMITED, Hong Kong (HK)

(72) Inventor: Emily Tang, Hong Kong (HK)

(73) Assignee: STUDIO DOOZY LIMITED, Hong Kong (HK)

( * ) Notice: Subject to any disclaimer, the term of this patent is extended or adjusted under 35 U.S.C. 154(b) by 0 days.

(21) Appl. No.: 18/639,959

(22) Filed: Apr. 18, 2024

(65) Prior Publication Data

US 2024/0260797 A1 Aug. 8, 2024

Related U.S. Application Data

(62) Division of application No. 17/642,947, filed as application No. PCT/CN2020/114838 on Sep. 11, 2020, now Pat. No. 11,986,133.

(30) Foreign Application Priority Data

Sep. 13, 2019 (HK) ..... 19129630.0

(51) Int. Cl.
*A47K 17/02* (2006.01)
*A47K 17/00* (2006.01)

(52) U.S. Cl.
CPC ..... *A47K 17/026* (2013.01); *A47K 2017/006* (2013.01)

(58) Field of Classification Search
CPC .... A47K 13/10; A47K 17/026; A61G 7/1076; A61G 7/1007; A61G 7/1003
See application file for complete search history.

(56) References Cited

U.S. PATENT DOCUMENTS

| | | | | |
|---|---|---|---|---|
| 5,068,930 | A * | 12/1991 | Ruggiero | A61G 7/1059 4/560.1 |
| 5,347,662 | A * | 9/1994 | Carper-White | A47K 13/00 4/237 |
| 8,181,285 | B1 * | 5/2012 | Jackson | A47K 3/122 4/578.1 |
| 10,898,038 | B1 * | 1/2021 | Greene | A47K 13/10 |

FOREIGN PATENT DOCUMENTS

| | | | |
|---|---|---|---|
| CN | 105263456 | A | 1/2016 |
| EP | 2448462 | B1 | 10/2014 |
| JP | 3424543 | B2 | 7/2003 |
| JP | 3141249 | U | 5/2008 |
| JP | 2017189386 | A | 10/2017 |
| KR | 20150015688 | A | 2/2015 |

* cited by examiner

*Primary Examiner* — Erin Deery
(74) *Attorney, Agent, or Firm* — IDEA Intellectual Limited; Margaret A. Burke; Sam T. Yip

(57) ABSTRACT

A system and a method for a seat apparatus (100, 400) comprising a base (102); a seat (106), wherein the seat (106) is moveably connected to the base (102) such that the seat (106) is rotatable relative to the base (102); a locking assembly (300, 500) associated with the seat (106), the locking assembly (300, 500) configured to lock the seat (106) in one or more positions relative to the base (102); the locking assembly (300, 500) comprising a trigger (302, 502) that is manually actuable by a user; wherein the seat (106) is unlocked when the trigger (302, 502) is actuated, to allow the seat (106) to rotate relative to the base (102).

18 Claims, 20 Drawing Sheets

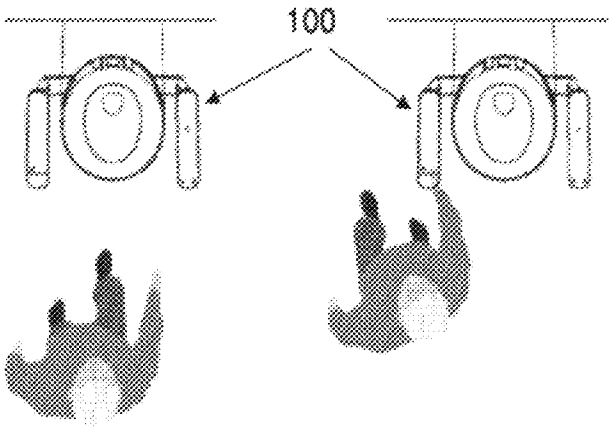
FIG. 15A
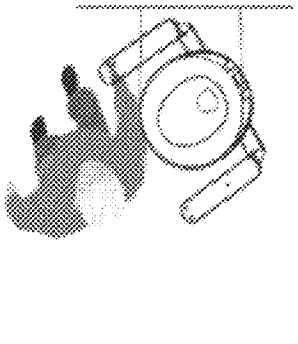
FIG. 15B
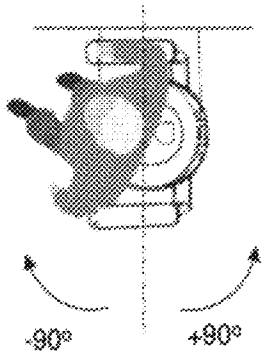
FIG. 15C
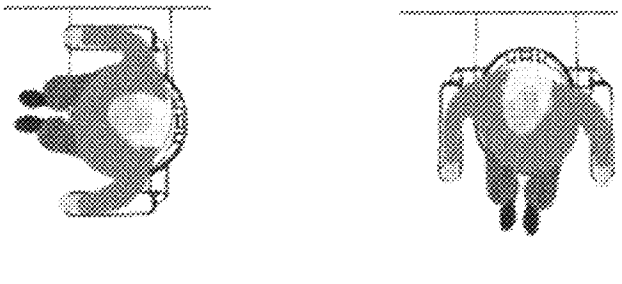
FIG. 15D
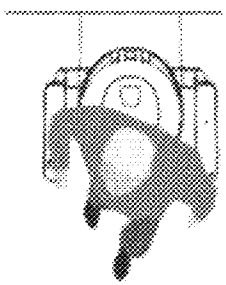
FIG. 15E
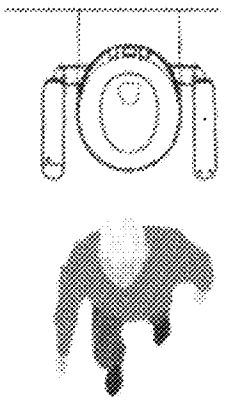
FIG. 15F
FIG. 15G
FIG. 15H

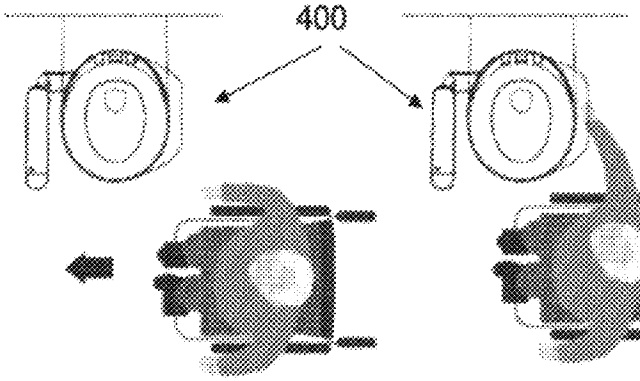
FIG. 16A
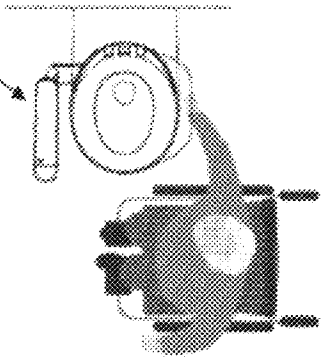
FIG. 16B
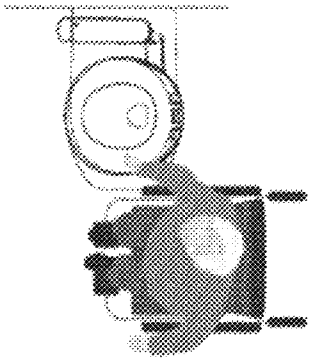
FIG. 16C
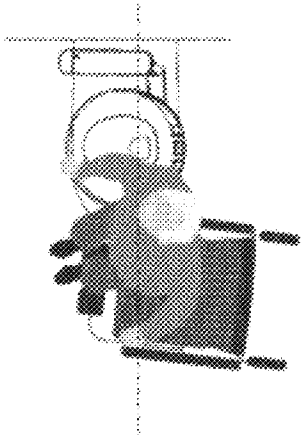
FIG. 16D
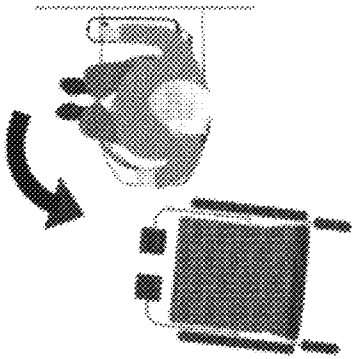
FIG. 16E
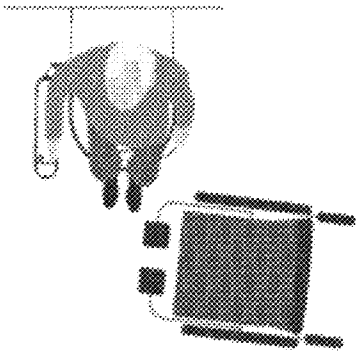
FIG. 16F
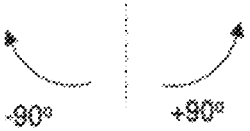

SEAT APPARATUS, MODULAR SEAT AND ROTATION MECHANISM

CROSS-REFERENCE TO RELATED APPLICATIONS

The present application is a divisional of the U.S. non-provisional patent application Ser. No. 17/642,947 filed Mar. 14, 2022, and the disclosure of which is incorporated herein by reference in its entirety.

FIELD OF THE INVENTION

The present disclosure relates to a seat apparatus and particularly, although not exclusively, to a seat apparatus includes a rotation mechanism.

BACKGROUND OF THE INVENTION

Physically disabled individuals and individuals with limited mobility often have difficulty sitting on and getting up from seats. The range of motions afforded by these individuals may be limited and in turn, simple movements such as mounting and dismount from a toilet or chair may be difficult, painful and in some instances dangerous due to the risk of falls or injuries. Such difficulty and pain may even cause some individuals, particularly the elderly, to avoid or refuse to use toilets or other equipment, resulting in further aggravations in various medical conditions.

Such individuals may also suffer the consequences of accessing tight spaces such as toilets or bathrooms that are often small and do not have much turning room. Disabled toilets often have to be built to a larger size but this can be difficult within a home e.g. in apartments or other high density housing. Disabled bathrooms often require large spaces and also often require multiple gripping bars on both sides of the toilet for safe transfer onto the toilet. In small, tight spaces e.g. home bathrooms and toilets elderly and disabled individuals accommodations that have limited space and turning room, it can be difficult for such individuals to use seats e.g. toilets or shower chairs as there is limited room to manoeuvre a wheelchair or other mobility aids. In an average sized home (that is not custom built) it is often difficult to allocate a large space for the toilet and/or bathroom to fit a wheelchair. This often makes it challenging for wheelchair users to safely transfer onto a toilet or shower chair. Similarly, individuals with limited mobility e.g. elderly individuals or individuals with injuries can find it difficult to safely sit on the toilet within tight spaces such as in a home toilet.

SUMMARY OF THE INVENTION

The present disclosure relates to a seat apparatus. In particular, the present disclosure relates to a seat apparatus for use in a bathroom. The seat apparatus may be used in a home setting or in public toilets. The present disclosure relates to a seat apparatus for use in a bathroom or toilet that makes using the particular seat easier for disabled individuals or individuals with limited mobility, or at least provides the public with a useful alternative.

The present disclosure further relates to a modular seat apparatus that comprises a plurality of detachable parts that can be interconnected to create various forms i.e. configurations of a seat apparatus. The modular parts may be attached together to create one of a plurality of predefined form i.e. a predefined configuration. The modular parts are easy to install and uninstall.

According to a first aspect the present disclosure relates to a seat apparatus comprising:

- a base;
- a seat, wherein the seat is moveably connected to the base such that the seat is rotatable relative to the base;
- a locking assembly associated with the seat, the locking assembly configured to lock the seat in one or more positions relative to the base;
- the locking assembly comprising a trigger that is manually actuable by a user;
- wherein the seat is unlocked when the trigger is actuated, to allow the seat to rotate relative to the base.

In one configuration the seat is rotatable between an operative position and one or more other rotated positions, and the seat being lockable at an operative position and the one or more rotated positions by the locking assembly.

In one configuration the locking assembly comprises a locking peg, the trigger is in mechanical communication with locking peg, wherein the locking peg is biased toward a locking position to lock the seat relative to the base and the locking peg being moved to an unlocked position when the trigger is actuated.

In one configuration the trigger is manually actuable by a user to unlock the locking peg and seat such that the seat can rotate relative to the base.

In one configuration the seat apparatus comprises:

- a locking plate attached the base,
- a swivel plate attached to the seat,
- a bearing positioned between the locking plate and the swivel plate, the bearing rotatably coupling the swivel plate to the locking plate such that seat can rotated relative to the base.

In one configuration the swivel plate supports the seat and the locking plate is attached to the base.

In one configuration the bearing comprises a thrust bearing.

In one configuration the thrust bearing comprises thrust ball bearing configured to operate in an axial load.

In one configuration the seat apparatus further comprises a platform and a lid, wherein the platform is coupled to the swivel plate;

- wherein the lid and the seat are pivotably coupled to the platform such that the seat and/or the lid can pivot relative to the platform;
- the seat pivotable between an operative position where the seat rests on the platform and a stowed position where the seat is lifted up and away from the platform, and;
- the lid pivotable between a closed position where the lid rests on the seat to cover the seat and an open position where the lid is pivoted away from the seat.

In one configuration the locking plate comprises a plurality of apertures, wherein each aperture corresponds to a position of the seat relative to the base, and each aperture sized and shaped to receive the locking peg into the apertures.

In use the locking peg is received into one or the plurality of apertures to lock the seat in a rotated position or an operative position and the locking peg being disengaged from an aperture of the plurality of apertures when the trigger is actuated by a user.

In one configuration the seat is rotatable about a vertical axis of the base and wherein the seat and the base are arranged co-axially relative to each other such that the base and the seat share the same vertical axis.

In one configuration the trigger comprises an actuating lever, the actuating lever pivotable between a latching position and an unlatching position, pivoting the actuating lever from the latching position to the unlatching position causes the locking peg to move from locking position to an unlocked position.

In one configuration when the actuating lever is in the latching position the locking peg is in the locking position and when the actuating lever is in the unlatching position the locking peg is in the unlocked position.

In one configuration the locking assembly comprises a biasing member coupled to the actuating lever and wherein the actuating lever is biased toward the latched position by the biasing member.

In one configuration the biasing member further biasing the locking peg toward a locking position to lock the seat relative to the base.

In one configuration the locking assembly comprises a locking arm, the locking peg extending outwardly from the locking arm, the locking arm is mechanically coupled to the trigger, the locking arm is moveable to cause the locking peg to move between the locking position and the unlocking position.

In one configuration the locking arm is moved to cause the locking peg to disengage from an aperture in the locking plate or to engage an aperture in the locking plate, wherein in use, actuating the trigger causes the trigger to mechanically move the locking arm thereby causing the locking peg to disengage from an aperture in the locking plate such that the swivel plate and seat can rotate relative to the base.

In one configuration the locking peg is located at one end of the locking arm and the locking peg is attached to the locking arm or integrally formed with the locking arm.

In one configuration the locking assembly comprises a link arm, the link arm located between the locking arm and the trigger, one end of the link arm being connected to the locking arm and in mechanical communication with the trigger, wherein the link arm moving in response to actuation of the trigger and thereby moving the locking arm and the locking peg.

In one configuration the locking assembly comprises a cable, a first end of the cable is connected to the trigger and a second end of the cable in mechanical communication with the locking peg, wherein actuating the trigger causes the cable to be pulled and the cable pulling the locking peg from a locked position to an unlocked position to unlock the seat from the base and allow rotation of the seat.

In one configuration the locking assembly comprises a cable, a first end of the cable is connected to the trigger and a second end of the cable is connected to proximal end of the link arm;

a distal end of the link arm coupled to a proximal end of the locking arm and the locking peg disposed at a distal end of the locking arm;

in use, actuating the trigger creates a pull force on the cable causing the cable to be pulled, the cable being pulled causes the link arm and locking arm to move thereby causing the locking peg to move from a locked position to an unlocked position such that the locking peg is disengaged from an aperture in the locking plate, and;

in use, when the trigger is released the pull force is removed causing the cable to move away from the trigger, the movement of the trigger causing the link arm and the locking arm to move thereby causing the locking peg to move to a locked position from an unlocked position such that the locking peg engages an aperture in the locking plate.

In one configuration the pull force on the cable causes link arm to pivot about a centre of the link arm such that the proximal end of the link arm moves in the direction of the movement of the cable and the distal end of the link arm moves in an opposing direction of the movement of the cable, and;

the proximal end of the locking arm moves in a direction parallel to the direction of the distal end of the link arm and the distal end of the locking arm moves in a direction parallel to the proximal end of the link arm thereby moving the locking peg to an unlocked position.

In one configuration the seat apparatus comprises an armrest, the armrest is removably coupled to the swivel plate and the locking assembly is associated with the arm rest.

In one configuration the armrest if sandwiched between the swivel plate and the platform.

In one configuration the armrest comprises a support member and a vertical strut that is connected to and holds up the support member, the vertical strut is coupled to the swivel plate, wherein the locking assembly associated with the armrest and the trigger is positioned on or within the support member.

In one configuration the seat apparatus comprises a pair of armrests, wherein each armrest located at radial opposing locations of the seat, each arm rest being removably coupled to swivel plate, and wherein the locking assembly is associated only with the first armrest and the trigger is positioned on or within the first armrest.

In one configuration the first armrest and the second armrest each comprises a support member and a vertical strut connected to a corresponding support member, wherein each vertical strut comprises a hollow tube having a connecting end and a support end, the connecting end comprises a connection opening;

the first armrest and the second armrest each comprising an elongate stanchion positioned within the respective hollow tube of each respective strut, each elongate stanchion comprising a connection end and a support end, wherein each elongate stanchion comprises one or more holes located at its connection end;

the swivel plate comprises a first and a second connection projection, the first and second connection projections extending outwardly from the swivel plate in opposing directions; the first connection projection received into the connection opening of a first armrest, the second connecting projection being received into the connection opening of the second armrest; the first connection projection is removably fastened to the elongate stanchion of the first armrest at a connection end of the stanchion by one or more fasteners such that the first armrest is removably coupled to the swivel plate and the second connection projection is removably fastened to the elongate stanchion of the second armrest at a connection end of the stanchion by one or more fasteners such that second armrest is removably coupled to the swivel plate, and;

wherein the one or more fasteners are received into the one or more holes located at the connection end of each elongate stanchion.

In configuration each of the first connection projection and second connection projection comprises a pair of connection fingers, each finger including an opening that aligns with the holes of the respective stanchion such that in use, one or more fasteners are passed through the opening of each finger and into the one or more holes of the respective stanchions to connect each armrest to the swivel plate.

In one configuration each support member comprises a housing, wherein the trigger is mounted within the housing of the first armrest support member and the locking assembly is disposed within the tube of the first armrest vertical strut, the locking assembly extending through the tube such that the locking peg extends out of the connection opening of the first armrest strut to engage and disengage from the locking plate and each housing is defined by a base and a lid.

In one configuration the first armrest and second armrest support member each comprise a housing defined by a base and a removable lid.

In one configuration the first armrest comprises a container member and a lid, wherein the container comprises an access opening therein, the container comprises frame disposed within the container;

the frame comprises a trigger mount, the trigger comprising the actuating lever and a lever housing, wherein the actuating lever is fitted within lever housing;

the lever housing mounted to the trigger mount, the lever housing mounted such that a portion of the actuating lever extends through the access opening to allow a user to access and actuate the actuating lever, the lever housing mounted such that the actuating lever can pivot about the trigger mount when the actuating lever is actuated by a user from a latched position to an unlatched position, and;

a biasing means mounted at or adjacent the trigger mount within the lever housing, the biasing member biasing the lever toward the latched position, and wherein when the actuating lever is in a latched position the locking peg is in a locked position and when the actuating lever is moved to an unlatched position the locking peg is moved to an unlocking position.

In one configuration the cable extends from the actuating lever through the housing of the first armrest, through the tube defined by the vertical strut of the first armrest and connects to the link arm, the link arm and the locking arm are disposed within the vertical strut adjacent the connecting end of the vertical strut;

the first armrest further comprises a tension adjuster located within the tube defined by vertical strut, the tension adjusted located adjacent the link arm and configured to maintain the tension of the cable at a predefined tension, and;

the first armrest further comprises a cable lock disposed within the container, the cable passing through the cable lock and the tension adjuster, wherein the cable lock is configured to lock the cable from movement when the actuating lever is in the latched position and unlock the cable to allow the cable to move relative to the first armrest when the actuating lever is actuated to an unlatched position.

In one configuration the trigger is actuated by squeezing the exposed portion of the actuating lever to cause the cable to be pulled thereby causing the locking peg to unlock and allow a user to swivel or rotate the seat relative to the base.

In one configuration the trigger comprises a projection, the projecting including a handle formed at a proximal end, a distal end of the projection coupled to a proximal end of the locking arm and the locking peg attached to or integrally formed at a distal end of the locking arm.

In one configuration the trigger is actuated by a user moving the handle to an unlatched position, the handle moving to an unlatched position causes the projection to move in an opposing direction to the handle, the movement of the projection causes the locking arm to pivot about a pivot point along the locking arm, wherein the proximal end of the locking arm moves in the same direction as the distal end of the projection and the distal end of the locking arm moves in an opposing direction to cause the locking peg to move to an unlocked position.

In one configuration the seat apparatus comprises a bench, the bench being removably attached to the swivel plate.

In one configuration the bench comprises a body, wherein the body is in the shape of a planar slab.

In one configuration the swivel plate comprises a first connection projection extending outward from the swivel plate, the bench comprising a connection opening formed in a body of the bench, and the first connection projection being received into the connection opening when the bench is connected to the first connection projection.

In one configuration bench is friction fitted onto the first connection projection or the bench is fastened to the first connection projection by one or more fasteners.

In configuration the seat is configured to rotate between 0 and 360 degrees relative to the base.

In one configuration the seat is configured to rotate positive 90 degrees and negative 90 degrees from the operative position, relative to the base.

In one configuration the seat is configured to be locked at an operative position or at a first locked position or a second locked position, wherein the first locked position corresponds to positive 90 degrees from the operative position and the second locked position corresponds to negative 90 degrees from the operative position.

The seat apparatus comprises a modular apparatus, one of more accessories of the seat apparatus can be interchanged to create a first seat apparatus form or a second seat apparatus form, wherein the accessories comprise a first armrest and a bench, and wherein the first seat apparatus form comprises a pair of armrests and the second seat apparatus form comprises an armrest and a bench.

In one configuration a first armrest including a locking assembly is removably attached to the swivel plate and the bench including a locking assembly is removably attached to the swivel plate, the first seat apparatus form is constructed by attaching the first armrest to the swivel plate and the second seat apparatus form is constructed by detaching the first armrest and attaching the bench to the swivel plate.

In one configuration the seat apparatus is a toilet seat apparatus or a shower chair that is configured for use by physically disabled or partially disabled users.

In one configuration the seat apparatus comprises a pair of armrest, wherein at least one of the armrest includes a bench.

In one configuration the armrest having a bench may be manipulated between a first position and a second position, wherein the second position positions the bench adjacent to the seat.

In one configuration the armrest is manipulated by rotation between the first position and the second position.

According to a second aspect the present disclosure relates to a modular seat apparatus comprising:

a base;

a seat, wherein the seat is moveably connected to the base such that the seat is rotatable relative to the base;

a seat, wherein the seat is moveably connected to the base such that the seat is rotatable relative to the base;

the locking assembly comprising a trigger that is manually actuable by a user;

a plurality of accessories that are removably attachable to the seat, wherein the accessories comprise an armrest and a bench;

the accessories being interchangeably attachable to the seat, in use, a first seat apparatus form created by attaching the armrest to the seat and a second seat apparatus form created by attaching the bench to the seat.

In one configuration the armrest and the bench each comprising the locking assembly.

In one configuration the seat is rotatable between an operative position and one or more other rotated positions, and the seat being lockable at an operative position and the one or more rotated positions by the locking assembly.

In one configuration the armrest comprises a first locking assembly and the bench comprising a second locking assembly, each locking assembly comprising comprises a locking peg, the trigger is in mechanical communication with locking peg, wherein the locking peg is biased toward a locking position to lock the seat relative to the base and the locking peg being moved to an unlocked position when the trigger is actuated.

In one configuration the seat apparatus comprises:

a locking plate attached the base, a swivel plate attached to the seat, a bearing positioned between the locking plate and the swivel plate, the bearing rotatably coupling the swivel plate to the locking plate such that seat can rotated relative to the base.

In one configuration the swivel plate supports the seat and the locking plate is attached to the base.

In one configuration the bearing comprises a thrust bearing.

In one configuration the thrust bearing comprises thrust ball bearing configured to operate in an axial load.

In one configuration the seat apparatus further comprises a platform and a lid, wherein the platform is coupled to the swivel plate;

wherein the lid and the seat are pivotably coupled to the platform such that the seat and/or the lid can pivot relative to the platform;

the seat pivotable between an operative position where the seat rests on the platform and a stowed position where the seat is lifted up and away from the platform, and;

the lid pivotable between a closed position where the lid rests on the seat to cover the seat and an open position where the lid is pivoted away from the seat.

In one configuration the locking plate comprises a plurality of apertures, wherein each aperture corresponds to a position of the seat relative to the base, and each aperture sized and shaped to receive the locking peg into the apertures; and in use the locking peg is received into one or the plurality of apertures to lock the seat in a rotated position or an operative position and the locking peg being disengaged from an aperture of the plurality of apertures when the trigger is actuated by a user.

In one configuration the seat is rotatable about a vertical axis of the base and wherein the seat and the base are arranged co-axially relative to each other such that the base and the seat share the same vertical axis.

In one configuration the modular seat apparatus comprises a second armrest that is attached to the swivel plate, the second armrest comprising a support member and a vertical strut that is connected to and holds up the support member, the vertical strut is coupled to the swivel plate, and the interchangeable accessories comprising a first armrest including a first locking assembly and a bench including a second locking assembly.

In one configuration each locking assembly comprises a trigger, the trigger comprising an actuating lever, the actuating lever pivotable between a latching position and an unlatching position, pivoting the actuating lever from the latching position to the unlatching position causes the locking peg to move from locking position to an unlocked position, and when the actuating lever is in the latching position the locking peg is in the locking position and when the actuating lever is in the unlatching position the locking peg is in the unlocked position.

In one configuration each locking assembly comprises a biasing member coupled to the actuating lever and wherein the actuating lever is biased toward the latched position by the biasing member.

In one configuration each locking assembly comprises a locking arm, the locking peg extending outwardly from the locking arm, the locking arm is mechanically coupled to the trigger, the locking arm is moveable to cause the locking peg to move between the locking position and the unlocking position.

In one configuration each locking arm is moved to cause the locking peg to disengage from an aperture in the locking plate or to engage an aperture in the locking plate, wherein in use, actuating the trigger causes the trigger to mechanically move the locking arm thereby causing the locking peg to disengage from an aperture in the locking plate such that the swivel plate and seat can rotate relative to the base and wherein locking peg is located at one end of the locking arm and the locking peg is attached to the locking arm or integrally formed with the locking arm.

In one configuration the first locking assembly further comprises a cable and a link arm, the link arm being connected to the locking arm such that movement of the link arm causes the locking arm to move, a first end of the cable is connected to the trigger and a second end of the cable is connected to proximal end of the link arm;

a distal end of the link arm coupled to a proximal end of the locking arm and the locking peg disposed at a distal end of the locking arm;

in use, actuating the trigger creates a pull force on the cable causing the cable to be pulled, the cable being pulled causes the link arm and locking arm to move thereby causing the locking peg to move from a locked position to an unlocked position such that the locking peg is disengaged from an aperture in the locking plate, and;

in use, when the trigger is released the pull force is removed causing the cable to move away from the trigger, the movement of the trigger causing the link arm and the locking arm to move thereby causing the locking peg to move to a locked position from an unlocked position such that the locking peg engages an aperture in the locking plate.

In one configuration the second locking assembly comprises the trigger, a locking arm connected to the trigger and a locking peg located on the locking arm;

the trigger comprises a projection, the projecting including a handle formed at a proximal end, a distal end of the projection coupled to a proximal end of the locking arm and the locking peg attached to or integrally formed at a distal end of the locking arm;

the trigger is actuated by a user moving the handle to an unlatched position, the handle moving to an unlatched position causes the projection to move in an opposing direction to the handle, the movement of the projection causes the locking arm to pivot about a pivot point along the locking arm, wherein the proximal end of the locking arm moves in the same direction as the distal end of the projection and the distal end of the locking arm moves in an opposing direction to cause the locking peg to move to an unlocked position.

In one configuration the first armrest comprises a container and a lid, wherein the container comprises an access opening therein, the container comprises frame disposed within the container;

the frame comprises a trigger mount;

the trigger comprising an actuating lever and a lever housing, wherein the actuating lever is fitted within lever housing and the actuating lever is actuable by a user;

the lever housing mounted to the trigger mount;

the lever housing mounted such that a portion of the actuating lever extends through the access opening to allow a user to access and actuate the actuating lever, the lever housing mounted such that the actuating lever can pivot about the trigger mount when the actuating lever is actuated by a user from a latched position to an unlatched position;

the biasing means mounted at or adjacent the trigger mount within the lever housing, the biasing member biasing the lever toward the latched position, and wherein when the actuating lever is in a latched position the locking peg is in a locked position and when the actuating lever is moved to an unlatched position the locking peg is moved to an unlocking position, and; wherein the first locking assembly is located inside the first armrest.

In configuration the seat in both the first form and second form is configured to rotate between 0 and 360 degrees relative to the base.

In one configuration the seat in both the first form and the second form is configured to rotate positive 90 degrees and negative 90 degrees from the operative position, relative to the base.

In one configuration the seat apparatus is a modular toilet seat, the first form toilet seat is suited for use by a partially paralyzed user or a user with limited physical mobility and the second form toilet seat is suited for use by a wheelchair bound user.

According to a third aspect the present disclosure relates to a rotation mechanism for use with a seat apparatus, the rotation mechanism comprising:

a stationary locking plate;

a rotatable swivel plate, the swivel plate rotatable relative to the locking plate; a bearing rotationally attaching the swivel plate to the locking plate, the bearing comprising a thrust bearing that connects the swivel plate to the locking plate, a locking assembly associated with the seat, the locking assembly configured to lock the swivel plate in one or more positions relative to the locking plate;

the locking assembly comprising a trigger that is manually actuable by a user;

wherein the swivel plate is unlocked when the trigger is actuated, to allow the swivel plate to rotate relative to the locking plate.

In one configuration the thrust bearing comprises a thrust ball bearing.

In configuration the swivel plate, thrust bearing and locking plate comprise ring shaped plates with a central hole.

In one configuration the locking plate comprises a plurality of apertures, wherein each aperture corresponds to a position of the seat relative to the base, and each aperture sized and shaped to receive the locking peg into the apertures; and in use the locking peg is received into one or the plurality of apertures to lock the seat in a rotated position or an operative position and the locking peg being disengaged from an aperture of the plurality of apertures when the trigger is actuated by a user.

In one configuration the locking assembly comprises a locking arm, the locking peg extending outwardly from the locking arm, the locking arm is mechanically coupled to the trigger, the locking arm is moveable to cause the locking peg to move between the locking position and the unlocking position.

In one configuration the locking arm is moved to cause the locking peg to disengage from an aperture in the locking plate or to engage an aperture in the locking plate, wherein in use, actuating the trigger causes the trigger to mechanically move the locking arm thereby causing the locking peg to disengage from an aperture in the locking plate such that the swivel plate can rotate, and wherein locking peg is located at one end of the locking arm and the locking peg is attached to the locking arm or integrally formed with the locking arm.

In one configuration the locking assembly further comprises a cable and a link arm, the link arm being connected to the locking arm such that movement of the link arm causes the locking arm to move, a first end of the cable is connected to the trigger and a second end of the cable is connected to proximal end of the link arm;

a distal end of the link arm coupled to a proximal end of the locking arm and the locking peg disposed at a distal end of the locking arm;

in use, actuating the trigger creates a pull force on the cable causing the cable to be pulled, the cable being pulled causes the link arm and locking arm to move thereby causing the locking peg to move from a locked position to an unlocked position such that the locking peg is disengaged from an aperture in the locking plate, and;

in use, when the trigger is released the pull force is removed causing the cable to move away from the trigger, the movement of the trigger causing the link arm and the locking arm to move thereby causing the locking peg to move to a locked position from an unlocked position such that the locking peg engages an aperture in the locking plate.

In one configuration the locking assembly comprises the trigger, a locking arm connected to the trigger and a locking peg located on the locking arm;

the trigger comprises a projection, the projecting including a handle formed at a proximal end, a distal end of the projection coupled to a proximal end of the locking arm and the locking peg attached to or integrally formed at a distal end of the locking arm;

the trigger is actuated by a user moving the handle to an unlatched position, the handle moving to an unlatched position causes the projection to move in an opposing direction to the handle, the movement of the projection causes the locking arm to pivot about a pivot point along the locking arm, wherein the proximal end of the locking arm moves in the same direction as the distal end of the projection and the distal end of the locking arm moves in an opposing direction to cause the locking peg to move to an unlocked position.

Features from one or more embodiments or configurations described herein may be combined with features of one or more other embodiments or configurations. Additionally, more than one described embodiment or configuration or form may be used together during a process of respiratory support of a patient.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

It should be understood that alternative embodiments or configurations may comprise any or all combinations of two or more of the parts, elements or features illustrated, described or referred to in this specification.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

As used herein the term 'and/or' means 'and' or 'or', or where the context allows both.

In the following description like numbers denote like features.

As used herein "(s)" following a noun means the plural and/or singular forms of the noun.

In this specification, the word "comprising" and its variations, such as "comprises", has its usual meaning in accordance with International patent practice. That is, the word does not preclude additional or unrecited elements, substances or method steps, in addition to those specifically recited. Thus, the described apparatus, substance or method may have other elements, substances or steps in various embodiments. The term "comprising" (and its grammatical variations) as used herein are used in the inclusive sense of "having" or "including" and not in the sense of "consisting only of".

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

BRIEF DESCRIPTION OF THE DRAWINGS

Notwithstanding any other forms which may fall within the scope of the present disclosure, one or more embodiments of a seat apparatus will now be described, by way of example only, with reference to the accompanying drawings in which:

FIGS. 15A-15H illustrate a first form of the seat apparatus being used by a partially paralyzed individual.

FIGS. 16A-16F illustrate a second form of the seat apparatus being used by a wheelchair user.

DETAILED DESCRIPTION

The present disclosure relates to a seat apparatus. In particular, the present disclosure relates to a seat apparatus for use in a bathroom. The seat apparatus may be used in a home setting or in public toilets. The seat apparatus disclosed herein may be used as part of or may form a bath room fixture e.g. a toilet seat (i.e. toilet unit) or a fixed shower chair or other bathroom fixture. Alternatively, the seat apparatus disclosed herein may be used as a portable seat apparatus that can be used in a bathroom. For example, the seat apparatus may be used as a portable shower chair.

The seat apparatus disclosed is particularly useful as a toilet seat for physically disabled people or physically restricted people. For example, the seat apparatus is particularly useful as a toilet seat for wheel chair bound people or elderly people or injured people.

The present disclosure also relates to a seat apparatus that is modular. The seat apparatus includes a plurality of interchangeable parts that can be connected together to create different forms of seat apparatus. The parts may be interconnected to create one or more predefined forms of seat apparatus.

The seat apparatus comprises a base; a seat, wherein the seat is moveably connected to the base such that the seat is rotatable relative to the base; a locking assembly associated with the seat, the locking assembly configured to lock the seat in one or more positions relative to the base; the locking assembly further comprising a trigger that is manually actuable by a user; and wherein the trigger being actuable to unlock the seat to allow the seat to rotate relative to the base. In one configuration the seat is rotatable between an operative position and one or more other rotated positions, and the seat being lockable at an operative position and the one or more rotated positions by the locking assembly.

Figure 1A:
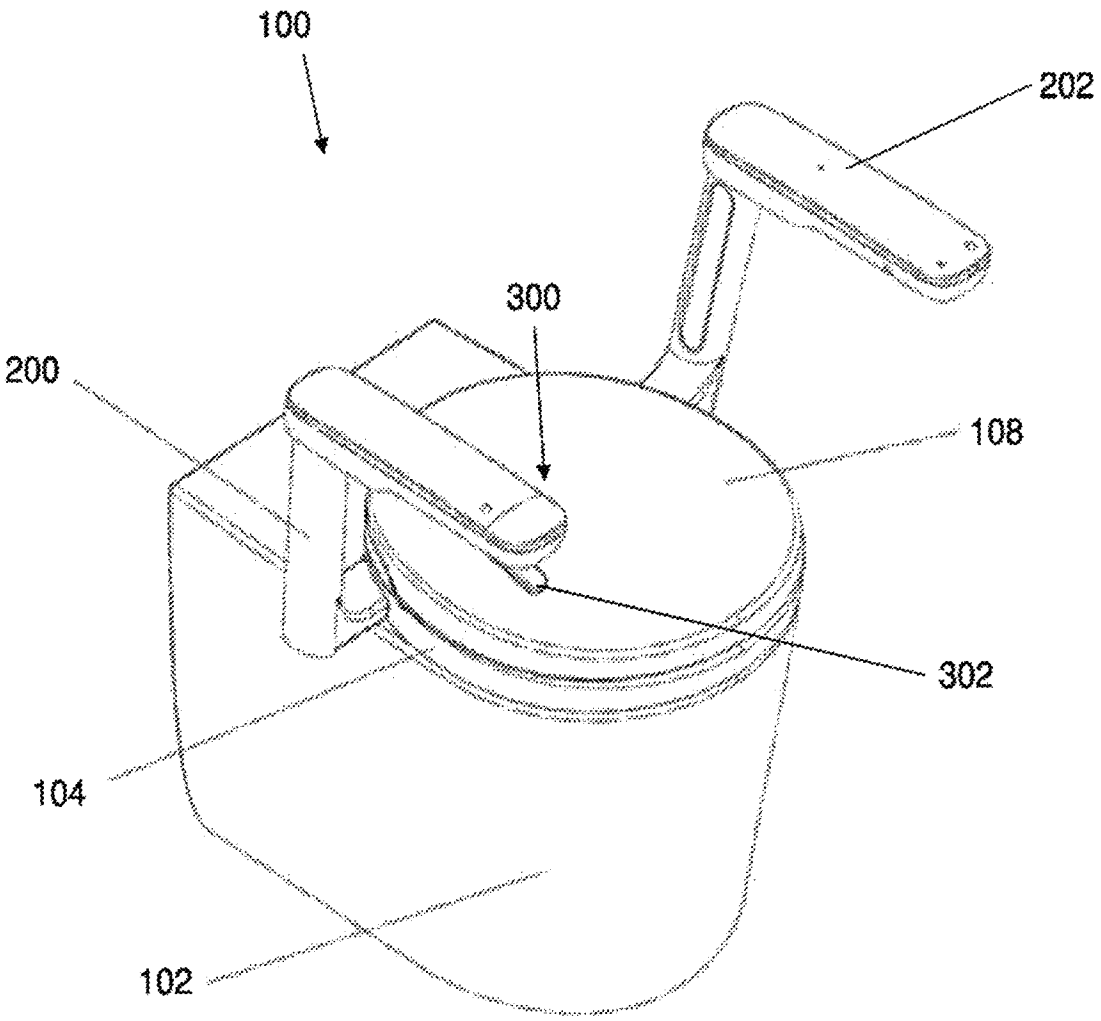
FIGS. 1A and 1B illustrate perspective views of one form of a seat apparatus.
Figure 1B:
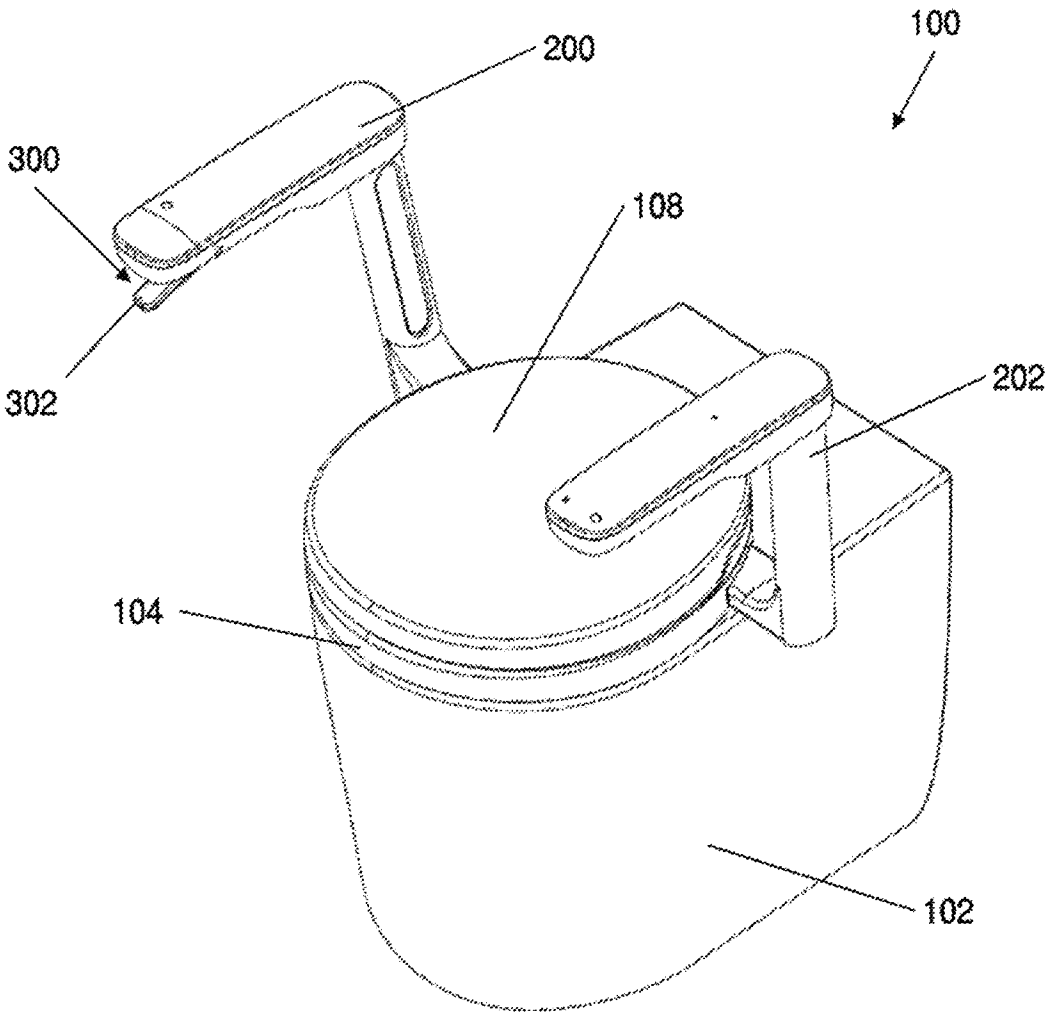

FIGS. 1A and 1B show perspective views of example form of a seat apparatus 100. The seat apparatus 100 as shown in the figures is a toilet seat. The seat apparatus 100 comprises a base 102. The base 102 may be a fixture in a bathroom. For the illustrated toilet 100, the base 102 may be a ceramic fixture that is installed in a toilet and plumbed in. The base 102 comprises a receptacle 10 with water and appropriate plumbing through the base to connect the receptacle 10 to sewage pipes.

The seat apparatus 100 also comprises a platform 104, a seat 106 and a lid 108. The seat 106 and lid 108 are connected to the platform 104. The platform 104 forms a support structure for the seat 106 and the lid 108. The base 102, the platform 104 and the seat 106 each include a central hole formed therein. The seat 106 and platform 104 are arranged on the base 102 such that hole in all three elements align and are coaxial. The hole in the base 102 leads to the receptacle 10 to collect waste from the user. The seat 106 and platform 104 are positioned on the base 102 such that all three elements have a common vertical axis (not shown) through the respective centre of each of the holes.

The seat 106 and lid 108 are pivotally coupled to the platform 104 i.e. such that the seat 106 and the lid 108 can be pivoted relative to the platform 104. The seat is pivotable relative to the platform 104 between an operative position where the seat rests on the platform and a stowed position where the seat is lifted up and away from the platform. In an operative position the seat 106 rests on the platform 104, such that a user can sit on the seat portion and use the toilet 100 (i.e. use the seat apparatus 100). The lid 108 is pivotable between a closed position and an open position. In the closed position the lid 108 rests on the seat 106 to cover hole and in the seat and in the open position the lid is pivoted away from the seat 106 and the platform 104.

The platform 104 is a ring shaped member. The seat 106 is a ring shaped member and includes a user interface surface that is exposed to the user. The user interface surface is the surface the user sits on i.e. interfaces with to use the seat apparatus 100. The user interface surface may be curved or may have other surface features e.g. a texture to improve comfort. The seat 106 may be formed of plastic or ceramic or other suitable material.

The seat 106 is moveably coupled to the base 102 such that the seat 106 can rotate relative to the base 102. The seat 106 can rotate (i.e. swivel) relative to the base and allows a user to change the orientation and position of the seat 106 relative to the base 106. The seat apparatus 100 comprises a plurality of parts that are assembled together to allow the seat 106 to rotate relative to the base 102. The seat 106 and platform 104 are rotatable (i.e. can swivel) relative to the base 102. The seat apparatus comprises a swivel plate 120, a locking plate 122 and a bearing 124 positioned between the swivel plate 120 and the locking plate 122. The bearing 124 connects the swivel plate 120 to the locking plate 122. The swivel plate 120, locking plate 122 and the bearing 124 forms a rotation mechanism. The rotation mechanism further comprises a locking assembly described later in the specification.

The swivel plate 120 comprises a first connection projection 125 and a second connection projection 126. The first and second connection projections 125, 126 extending outwardly from the swivel plate 120 in opposing directions. The first and second connection projections 125, 126 provide a connecting structure to removably attach armrests to the swivel plate 120.

Figure 2:
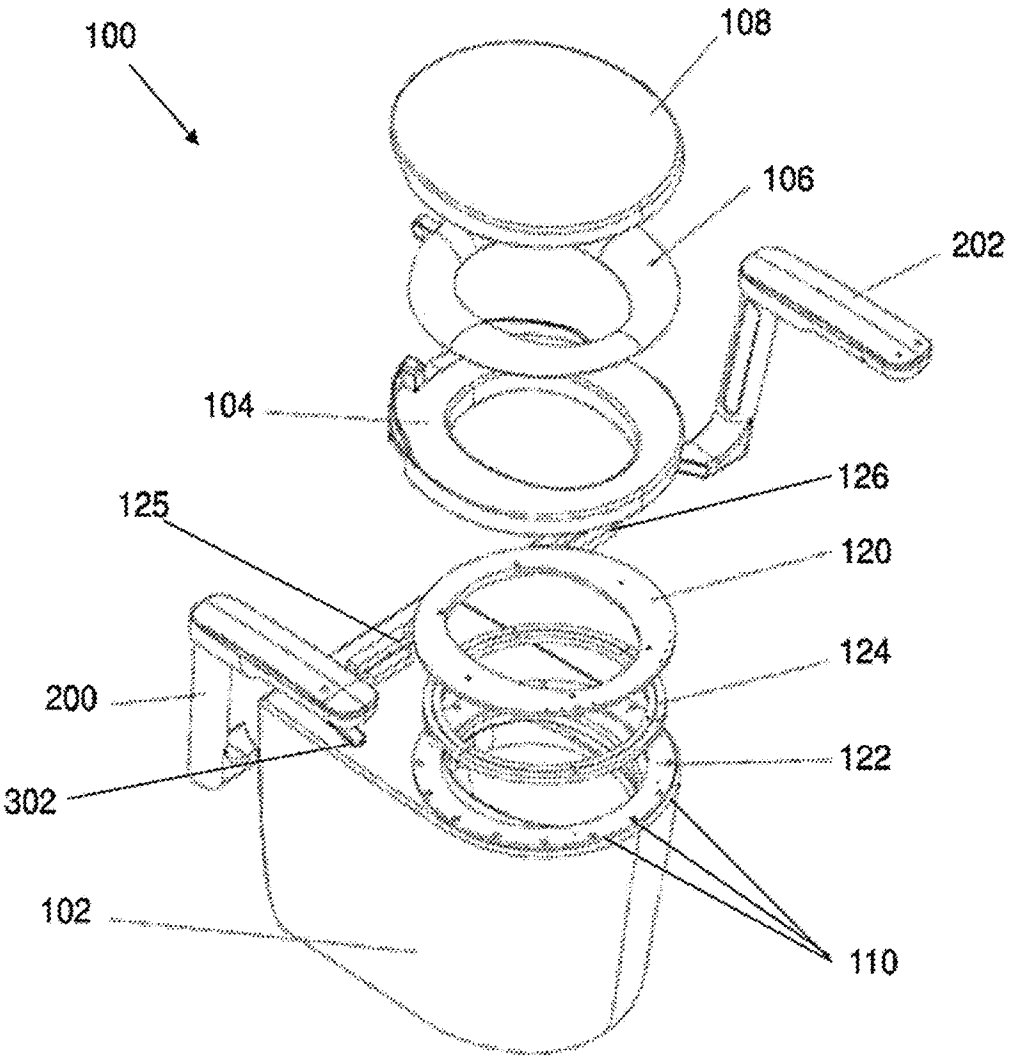
FIG. 2 illustrates an exploded view of the seat apparatus of FIGS. 1A and 1B.
Figure 3:
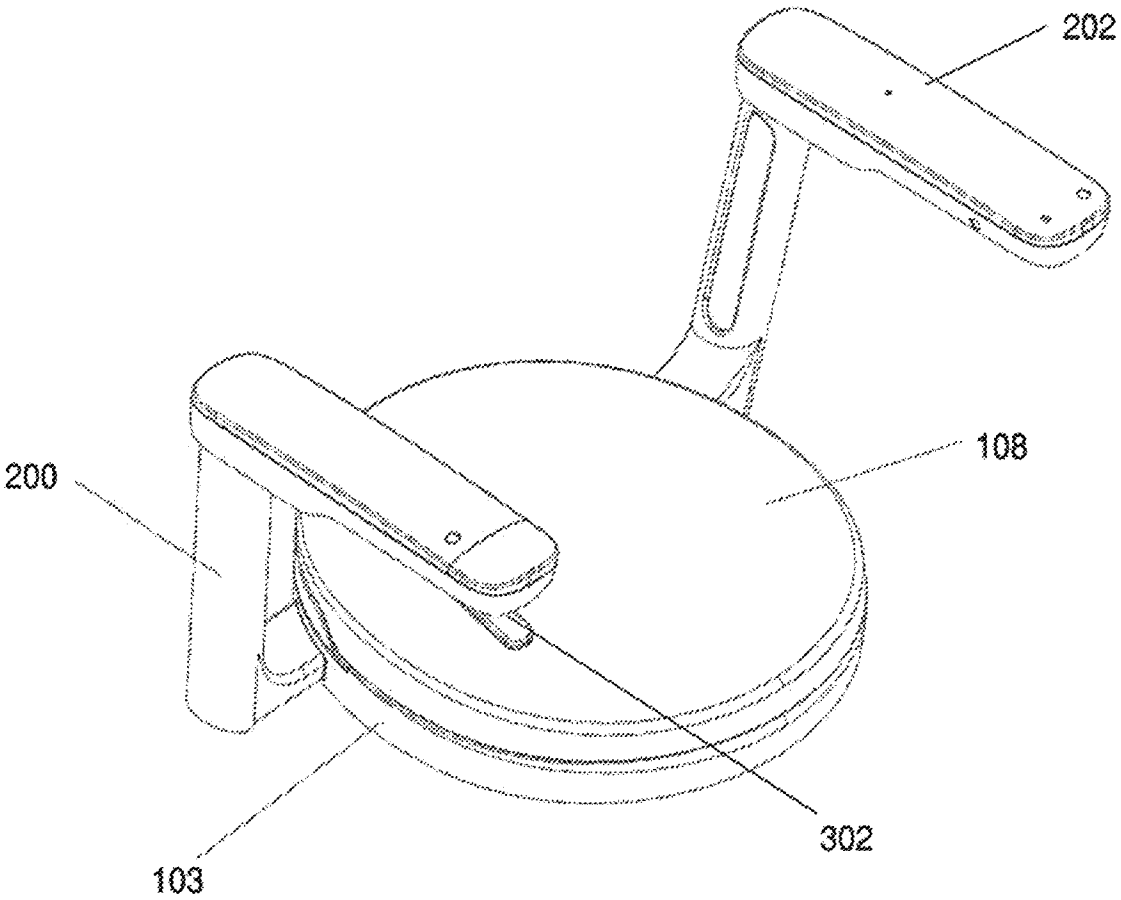
FIG. 3 illustrates a view of parts of the seat apparatus.
Figure 4:
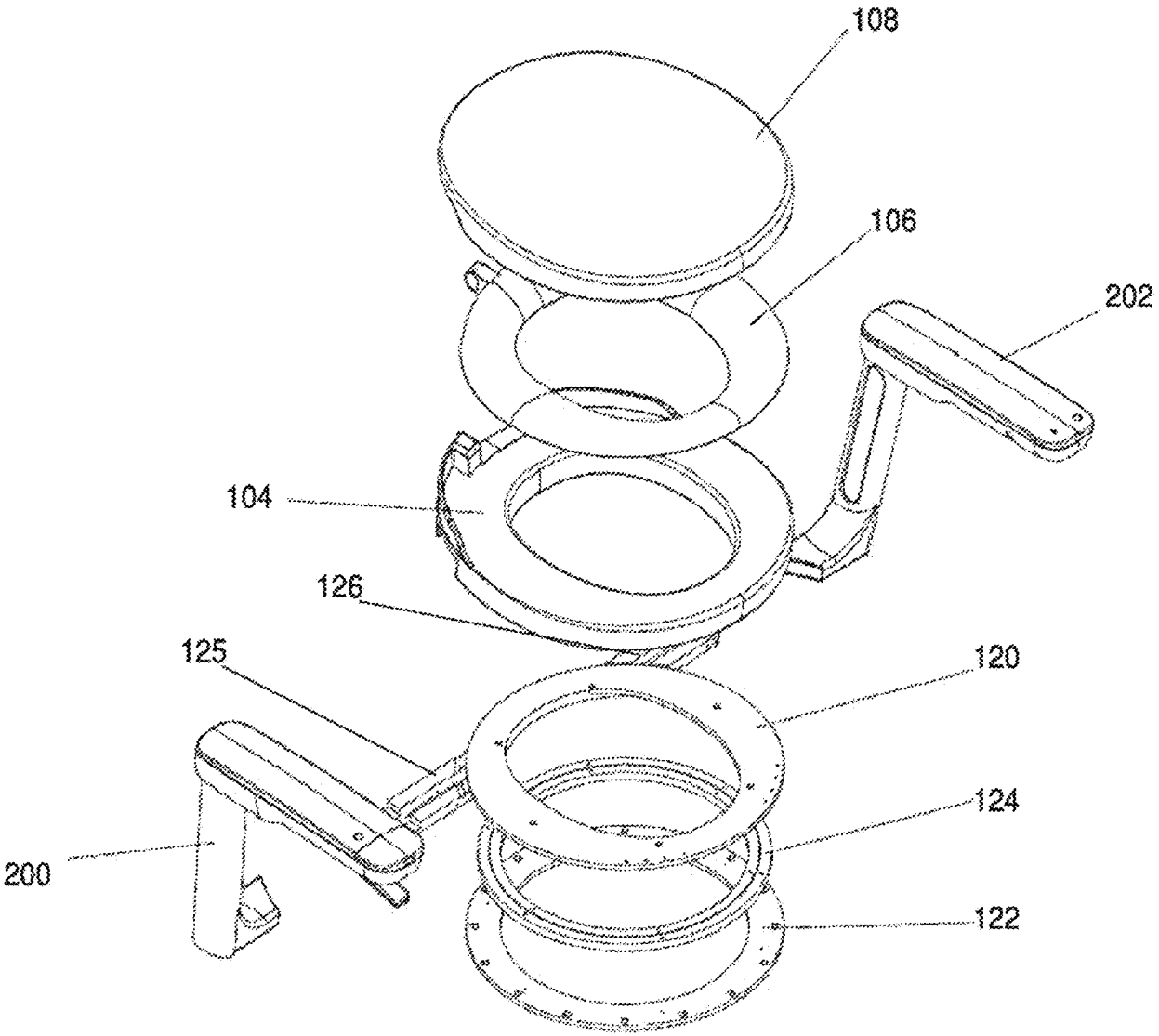
FIG. 4 illustrates an exploded view of the parts shown in FIG. 3.

The swivel plate 120 may be attached to the seat 102. In the illustrated example of the first form shown in FIG. 2 and FIG. 4, the swivel plate 120, the locking plate 122 and the bearing 124 are stacked on top of each other and the bearing 124 is sandwiched between the swivel plate and the locking plate. The swivel plate 120 is attached to an underside of the platform 104. The swivel plate 120 may be attached by a fastener or may be adhered to the platform 104. The locking plate 122 is attached to a topside of the base 102. The locking plate 122 may be attached by a fastener or may be adhered to a topside of the base 102. The locking plate includes one or more apertures 110. Each aperture corresponds to a position of the seat relative to the base, and each aperture sized and shaped to receive a locking peg into the apertures 110 to lock the position of the seat 106.

The bearing 124 rotatably couples the seat 106 to the base 102. In the illustrated form shown in figures the bearing rotatably interconnects the swivel plate 120 to the locking plate 122. The locking plate 122 is a stationary plate that is fixed to the base 102. The swivel plate 120 is configured to swivel i.e. rotate in use relative to the locking plate 122 and the base 102. The bearing 124 in the illustrated form is a thrust bearing. A thrust bearing is used because it permits rotation of the swivel plate 120 (and attached seat 106) relative to the fixed locking plate 122 (and fixed base 102), while supporting axial loads. Axial loading comes from a person sitting on the toilet to use the toilet. Persons using the toilet can be of varying sizes and weights. The thrust bearing is sized to account for a large weight range e.g. from 6 kg to 150 kg users. The thrust bearing is advantageous because it maintains function when exposed to axial loads e.g. when a user sits on the toilet 100.

Figure 13:
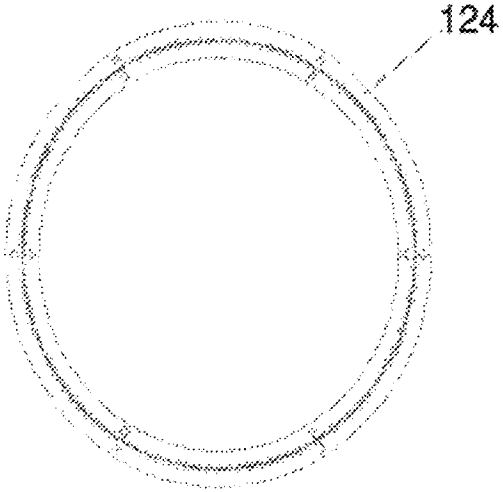
FIG. 13 illustrates a detailed view of the bearing of FIG. 12.

The thrust bearing 124 is fixed to both the swivel plate 120 and the locking plate 122. The thrust bearing 124 in the illustrated form is a ball bearing. The thrust bearing 124 comprises a thrust ball bearing or a thrust roller bearing. As shown in FIG. 13 the thrust bearing includes a plurality balls or rollers therein. The thrust bearing 124 may optionally include an upper washer that connects to the swivel plate 120, a lower washer that connects to the locking plate and a cage in the middle of the two washers. The cage retains the balls or rollers therein. FIG. 13 shows a top view of the bearing 124. As shown in FIG. 13 the bearing retains a plurality of balls within a cage. The balls provide a rolling surface to allow one washer to rotate relative to the other, thereby allowing the swivel plate 120 to rotate (i.e. swivel) relative to the locking platform, and hence allow the seat 106 to rotate relative to the base 102.

Figure 12:
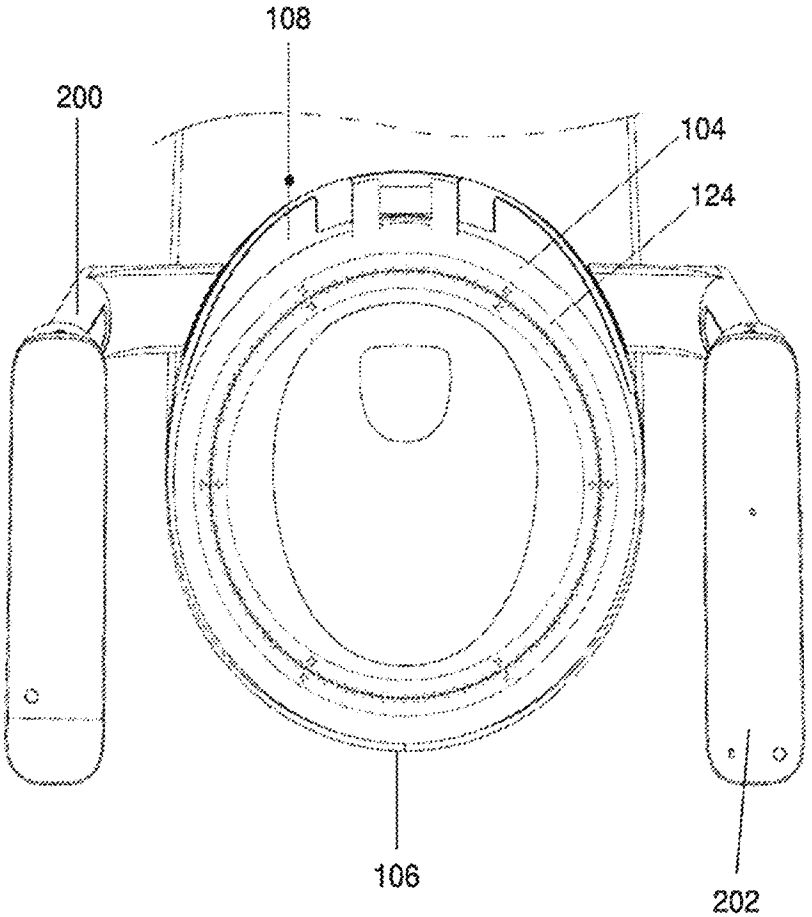
FIG. 12 illustrates a top view bearing in an installed position within the seat apparatus.

The thrust bearing 124 is also ring shaped with a central hole therein. The swivel plate 120 and the locking plate 122 are also ring shaped with a central hole. The central hole in the thrust bearing, swivel plate and locking plate aligns with and is coaxial with the central hole in the seat 106, the central hole in the platform 104 and the central hole in the base 102. The assembled seat apparatus 100 (toilet 100) comprises a central hole that defines an opening to allow a user to sit on the seat and deposit waste into the toilet 100. FIG. 12 shows an installed first seat apparatus form. As shown in FIG. 12, the central openings within the base 102, locking plate 122, bearing 124, swivel plate 120 and seat 106 are aligned to create a continuous opening. The receptacle 10 formed in the base 102 and the receptacle is open and accessible through the hole. This aligned stacked arrangement of the base, locking plate, bearing, swivel plate and seat allows a user to sit on the seat 106 and deposit waste into the receptacle 10.

As shown in at least FIGS. 1A and 1B, the first form of the seat apparatus 100 comprises a pair of armrests. The arm rests are configured in use to allow a user to rest their arms the armrest. The armrests can also function as a handle for disabled or physically less able users to move themselves onto the seat. The seat 106 is rotatable relative to the base 102. The seat 106 can swivel relative to the base 102. The armrests can function as a handle to grip and swivel the seat 106. The illustrated form in FIGS. 1A to 4 comprises a first armrest 200 and a second armrest 202. The armrests 200, 202 are located at radially opposing locations of the seat, as show in FIG. 4.

Figure 5:
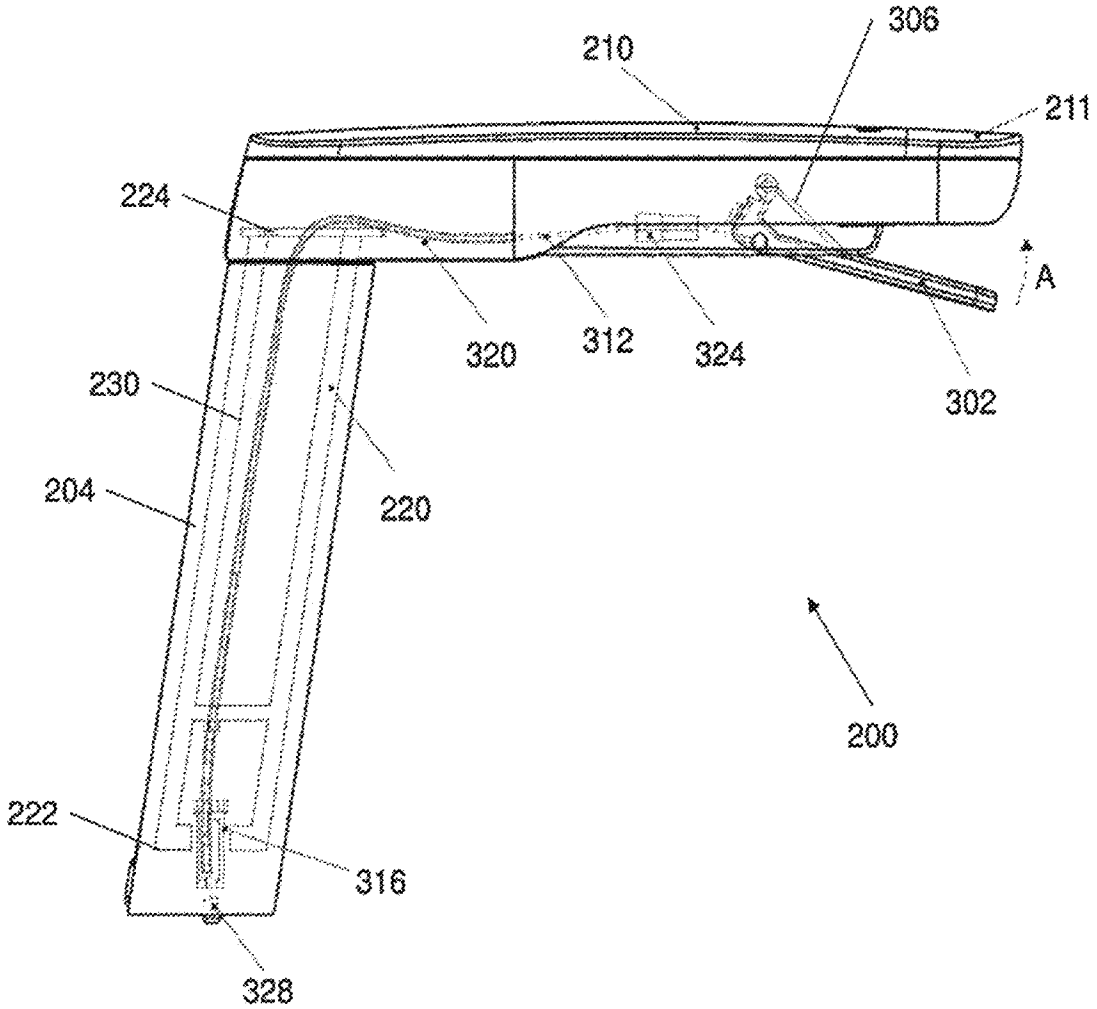
FIG. 5 illustrates a side view of an armrest with a layout of the locking assembly of the seat apparatus of FIGS. 1A-1B.
Figure 6:
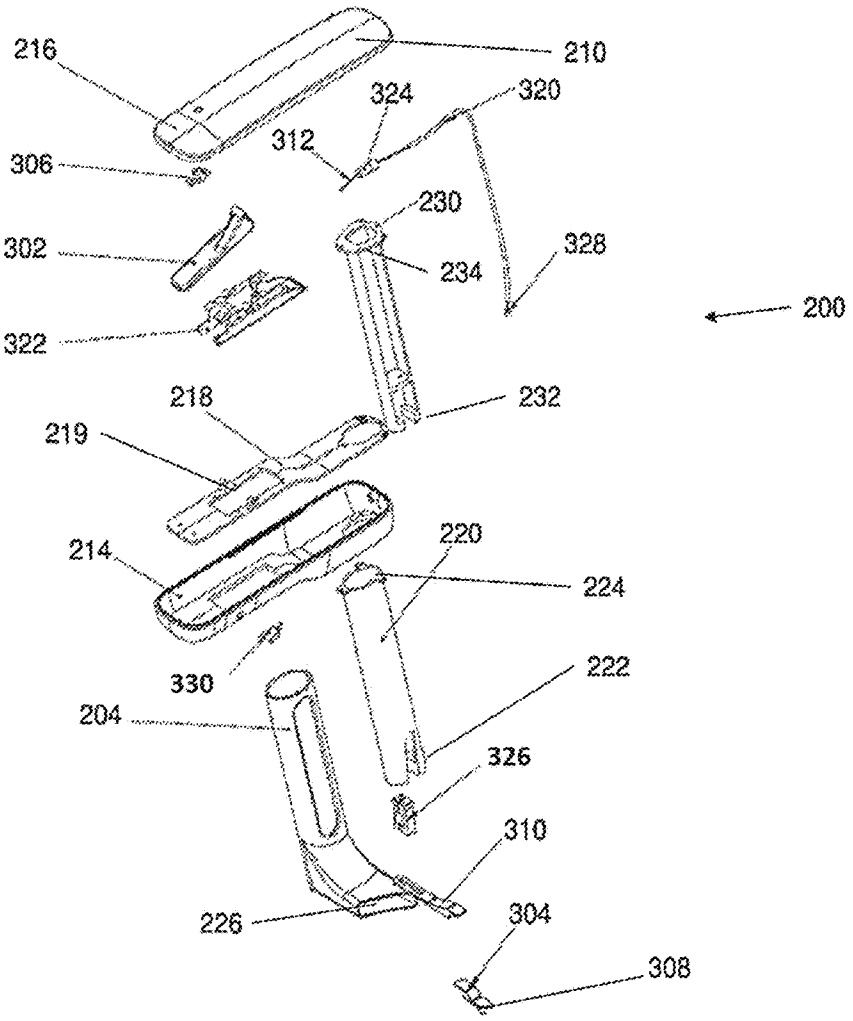
FIG. 6 illustrates an exploded view of the armrest of FIG. 5.

FIG. 5 shows a view of a first armrest of the first form of seat apparatus 100. FIG. 6 illustrates an exploded view of the first armrest 200, of the first form of seat apparatus 100. Each armrest 200, 202 is preferably removably coupled i.e. fastened to the swivel plate. In the illustrated example shown in FIGS. 3 and 4, each armrest 200, 202 is sandwiched between the swivel plate 120 and the platform 104. Each armrest comprises a support member 210 and a vertical strut 204 that is connected to and holds up the support member 210. The vertical strut 204 of each armrest 200, 202 is coupled to the swivel plate. The vertical strut of each armrest 200, 202 may also be coupled to the platform 104. The support member 210 may comprise a cushion or cushioning material to improve comfort of a user. Alternatively, the support member 210 may be a rigid plastic material. Each armrest 200, 202 is made of plastics material or a combination of metal and plastics or any other suitable material. The cushion or cushion member is formed of a suitable material that is soft. An upper side 211 of the support member 210 may be curved. The cushion is disposed on the upper side 211. The vertical strut 204 of each armrest 200, 202 is formed of a plastic material or a metal or a combination of rigid materials.

The vertical strut 204 of each armrest 200, 202 comprises a hollow tube 220, as shown in FIG. 6. The hollow tube 220 retains components of the locking assembly 300. The hollow tube 220 comprises a connecting end 222 and a support end 224. The support member 210 is located and connected to the support end 224. The connecting end 222 comprises a connection opening 226. The connection opening 226 is coupled to the swivel plate 120. Each armrest 200, 202 is coupled to the swivel plate 120 such that the armrests rotate when the seat 106 is rotated relative to the base 102.

The first armrest 200 and second armrest 202 each comprise an elongate stanchion 230 positioned within the hollow tube 220 of each respective armrest 200, 202, as shown in FIG. 5 and FIG. 6.

The elongate stanchion provides reinforcement for the vertical strut. The stanchion 230 provides a rigid structure and functions like a brace i.e. a spine to reduce deformation of the strut and allow the strut to support loads applied to the armrest 200, 202. Each elongate stanchion 230 comprising a connection end 232 and a support end 234. Each elongate stanchion comprises one or more holes disposed at the connection end 232. The stanchion 230 is formed of a rigid material. In one example construction the stanchion 230 is formed of metal. The first and second armrests are fastened to the swivel plate 120 by one or more fasteners. The first and second armrests comprise the above described parts.

Figure 11B:
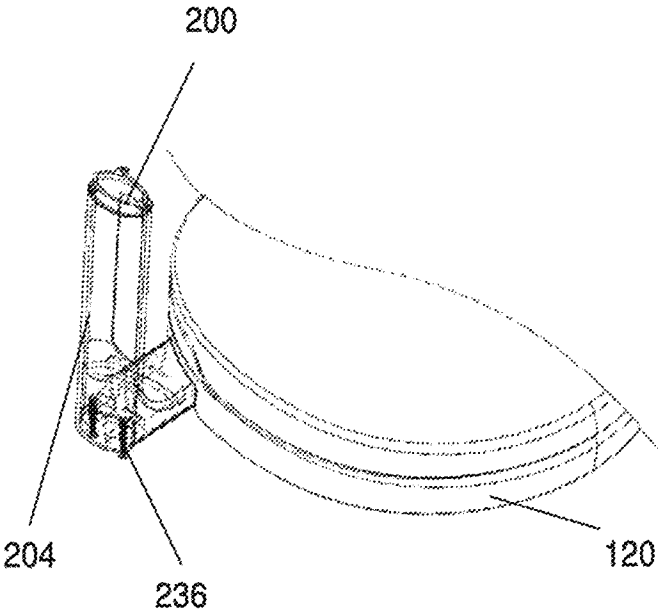
FIGS. 11A and 11B illustrate the coupling of the armrest of either the first or second form of seat apparatus.
Figure 11A:
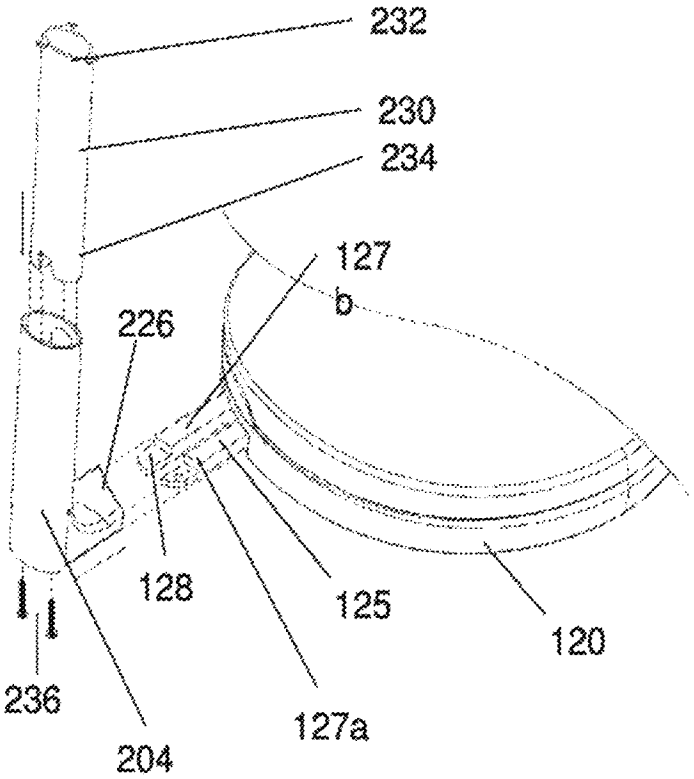

FIGS. 11A and 11B show an example of the coupling of the armrest to the swivel plate 120. As shown in FIG. 11A the first connection projection 125 is received into the connection opening 226 of a first armrest 200. The second connecting projection 126 is received into the connection opening 226 of the armrest 200. The connection opening of each armrest is slid over the connection projection, such that the connection projection is received within the connection opening 226.

The elongate stanchion 230 is inserted the hollow tube defined in the strut. The stanchion 230 of each arm is inserted in a direction perpendicular to the direction of attaching the armrest to the swivel plate. In the illustrated example of FIG. 11A, the stanchion is inserted vertically downward into the strut. Each armrest 200, 202 is slid over respective first and second connection projection 125, 126 in a horizontal direction. The first connection projection 125 is removably fastened to the elongate stanchion 230 of the first armrest at a connection end of the stanchion by one or more fasteners 129. The first armrest 200 is removably coupled to the swivel plate 120. The second connection projection 126 is removably fastened to the elongate stanchion 230 of the second armrest at a connection end of the stanchion by one or more fasteners. The second armrest 202 may be removably coupled to the swivel plate 120 or may be permanently coupled to the swivel plate 120. FIG. 11B illustrates a configuration of an armrest attached to the swivel plate. As shown in FIG. 11B, there are two fasteners 236 used and the fasteners are inserted from an underside of the connection projection.

In the illustrated example of FIG. 11A, each connection projection 125, 126 comprises a pair of connecting fingers 127*a*, 127*b*. The connecting fingers each include a connecting opening 128. The vertical strut and stanchion 230 of each armrest may also comprise a pair of openings on an underside. The fasteners are inserted through the connecting openings and into the underside of the stanchion 230 to affix the armrest to the swivel plate.

Referring to FIG. 6 the support member 210 of each armrest 200, 202 comprises a container 214 and a lid 216. FIG. 6 illustrates the separated container 214 and lid 216 defining the support member 210. The lid 216 may be removably attached to the container 214. An enclosed space is defined when the lid 216 is attached to the container. The container 214 comprises a body with curved sides defining a hollow bounded by the sides. Each armrest 200, 202 further comprises a frame 218. The frame 218 provides structure and acts as a load bearing element within the support member 210. Optionally the frame 218 comprises a trigger mount 219. FIG. 6 shows a n exploded view of a first armrest 200. The trigger mount 219 is only defined in the frame 218 of the first armrest. The second armrest 202 support member includes a frame 218 with no trigger mount. Alternatively, the frame 218 of both armrests 200, 202 may be identical.

The seat apparatus 100 is a first seat apparatus form 100. The first seat apparatus form 100 comprises a first locking assembly 300, as shown in FIGS. 5 to 7B. The first locking assembly 300 is also associated with the seat. The locking assembly 300 is configured to lock the seat 102 in one or more positions relative to the base 104. The first locking assembly 300 comprises a trigger 302 that is manually actuable by a user of the seat apparatus 100, wherein the seat 106 is unlocked when the trigger is actuated to allow the seat to rotate relative to the base 102. In use, the user can actuate the trigger 302 to unlock the seat from the base and allow a user to rotate (i.e. swivel) the seat 106 relative to the base 102. The seat 106 is rotatable between an operative position and one or more rotated positions. The seat 106 is lockable at the operative position and the one or more rotated positions by the locking assembly. The rotated positions correspond to a position that is rotated away from the operative position.

Figure 7B:
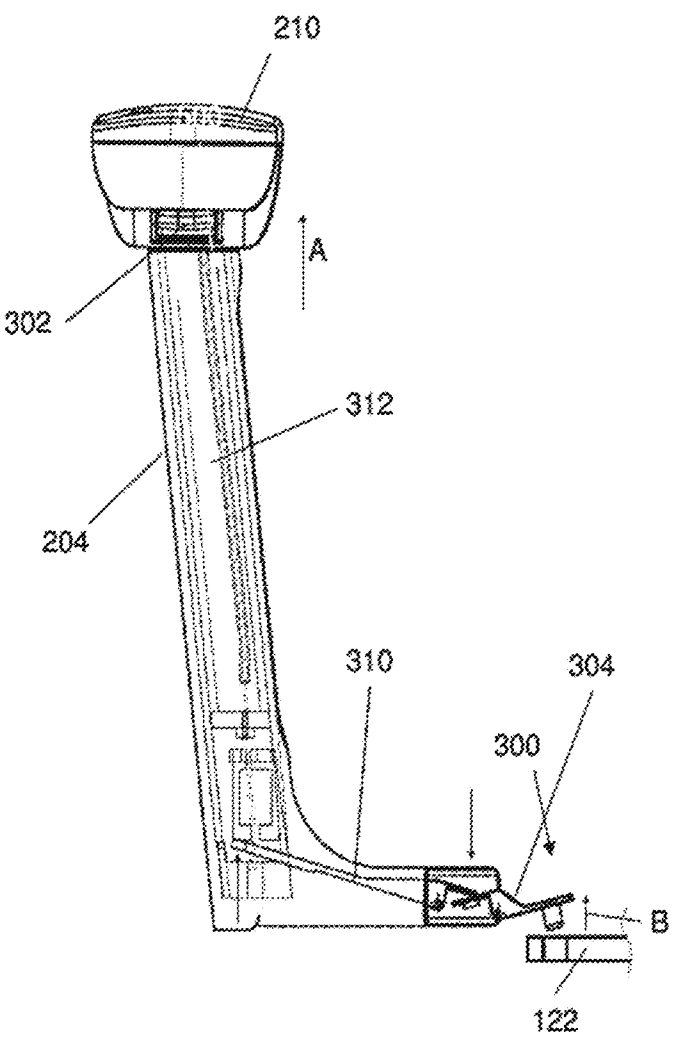
FIGS. 7A and 7B illustrate the operation of the locking assembly of the first seat apparatus form.
Figure 7A:
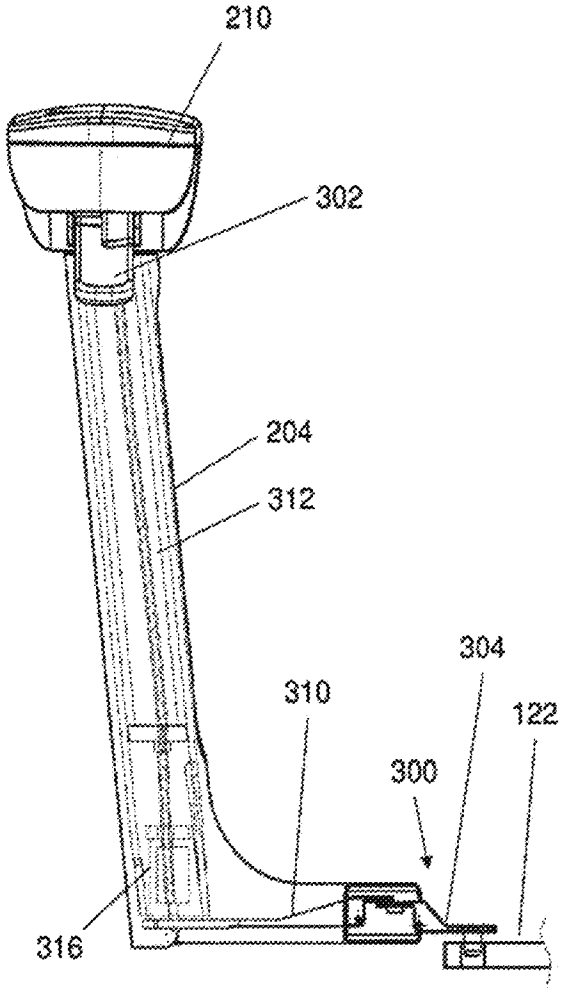

The first locking assembly 300 is associated with the first armrest 200. As shown in FIGS. 5 to 7B the first locking assembly 300 is disposed and contained within the first armrest 200. The first locking assembly comprises a trigger 302, a locking arm 304, a biasing member 306 and a locking peg 308. The locking peg 308 is attached to or integrally formed with the locking arm 304. The trigger 302 is an actuating lever. The actuating lever 302 is pivotable between a latching position and an unlatching position as shown in FIGS. 7A-7B. The lever is actuated in the direction of arrow A shown in FIG. 5, and FIG. 7B. In use, when the actuating lever is in the latching position the locking peg 308 is in the locking position and when the actuating lever 302 is in the unlatching (i.e. unlatched) position the locking peg is in the unlocked position, as shown in FIG. 7B.

The biasing member 306 is coupled to the actuating lever, as shown in FIG. 5. The biasing member 306 may be a coil spring or a leaf spring or another suitable spring. The biasing member 306 causes the trigger 302 (i.e. actuating lever) to be biased toward the latched position. This causes the locking peg 308 to be biased toward a locked position. The locking peg 308 is received into one of the apertures 110 of the locking plate 122 when the trigger is in the latched position and the peg 308 is in the locked position as shown in FIG. 7A. The locking peg 308 is disengaged from an aperture of the plurality of apertures when the trigger 302 is actuated by a user as shown in FIG. 7B. The locking peg moves upward in the direction of arrow B as shown in FIG. 7B.

The locking arm 304 is mechanically coupled to the trigger 302. The locking arm 304 is moveable to cause the locking peg to move between the locking position and the unlocking position. The locking assembly further comprises a link arm 310. The link arm 310 is located between the locking arm 304 and the trigger 302. One end of the link arm 310 is connected to the locking arm 304 and in mechanical communication with the trigger 302. The link arm 310 moves in response to actuation of the trigger 302 being actuated. The link arm 310 pivots and causes the locking arm 304 to pivot.

Referring again to FIGS. 5 to 7B the first locking assembly 300 further comprises a cable 312. A first end of the cable 312 is connected to the trigger 302 and a second end of the cable 312 is connected to a proximal end of the link arm 310. A distal end of the link arm 310 is coupled to a proximal end of the locking arm 304 and the locking peg 308 is located at a distal end of the locking arm 304. The link arm 310 may be connected to the locking arm 304 by a pin or fastener or may be adhered or welded on. The cable 312 is threaded through the link arm 310.

In use, actuating the trigger 302 creates a pull force on the cable 312 causing the cable to be pulled. The cable 312 being pulled causes the link arm 310 and locking arm 304 to move thereby causing the locking peg 308 to move from a locked position to an unlocked position. Further in use, when the trigger 302 is released, the pull force on the cable is removed causing the cable to move away from trigger 302. The trigger 302 being released to return to a latched position, the link arm and locking arm move thereby causing the locking peg to move to a locked position from an unlocked position such that the locking peg 308 engages an aperture 110 in the locking plate. Proximal refers to close or closer to the strut of the armrest. Distal refers to further away from the strut of the armrest.

The cable 312 may be a metal cable or a plastic cable e.g. a nylon cable. The cable 312 preferably is not axially stretchable. The cable 312 may comprise a high tensile strength and may be reasonably stiff in tension to avoid the cable straining in tension.

Referring to FIG. 6 the first locking assembly 300 also comprises a flexible pipe 320. The cable 312 is positioned within the pipe 320. The pipe 320 acts as a protective cover for the cable 312. Referring to FIGS. 5 and 6, the first locking assembly 300 comprises a lever housing 322. The lever housing 322 receives and retains the actuating lever 302 (i.e. trigger 302). The lever housing 322 is mounted on the trigger mount 219. A cable lock 324 is positioned mounted frame 218 and within the container 214. A tension adjuster 326 is positioned within the strut 204 of the first armrest 200. The cable 312 includes a stopper 328 that is located at a distal end i.e. second end of the cable. The stopper 328 prevents the cable 312 from being dislodged from the link arm 310. The cable 312 is threaded through a hole in the link arm. The stopper 328 is a bulbous element that is larger than the hole in the link arm 310 and prevents the cable 312 from being dislodged from the link arm when the trigger 302 is squeezed to an unlatching position.

The cable 312 is extends through the strut 202, and more specifically through the stanchion 230. The cable 312 passes through the cable lock 324 and the tension adjuster 326. The cable lock 324 is configured to lock the cable 312 from movement when the actuating lever 302 is in the latched position and unlock the cable 312 to allow the cable to move relative to the first armrest when the actuating lever is actuated to an unlatched position.

FIGS. 7A and 7B illustrate the first armrest 200 with the first locking assembly 300 disposed within the first armrest 200. FIG. 7A shows the trigger 302 in the latched position and the locking peg 308 engaged in an aperture 110 of the locking plate 122. The first locking assembly 300 is positioned to lock the seat 106 relative to the base 102. FIG. 7B shows the locking assembly 300 in use. As shown in FIG. 7B the user pulls upward on the trigger 302 to actuate the trigger 302. The trigger 302 is moved to an unlatched position. Movement of the trigger 302 causes the cable 312 to be pulled upwardly due to movement of the trigger 302. The pulling of the cable 312 causes the proximal end of the link arm 310 is pulled upward. The link arm 310 pivots about a central point along its body. The distal end of the link arm moves in an opposite direction to the proximal end i.e. the distal end moves downward. The locking arm 304 is also moved. The proximal end of the locking arm 304 moves downward (i.e. in the same direction as the distal end of the link arm 310). The distal end of the locking arm 304 moves upward due to the locking arm 304 pivoting. The distal end of the locking arm 304 moves upward to cause the locking peg 308 to disengage from the aperture 110 of the locking plate 122. The locking peg 308 is moved to an unlocked position. The trigger 302 being actuated, as shown in FIG. 7B, disengages the seat 106 from the base 102 and allows the seat 106 to be rotated. Preferably the trigger has to be manually held in the unlatched position to allow swiveling of the seat 106.

FIGS. 8A to 10B illustrate a second form of a seat apparatus 400. The second seat apparatus form 400 is a second configuration. The seat apparatus can be interchanged between the first form 100 and the second form 400. The second seat apparatus form 400 is substantially similar to the first seat apparatus form 100. The second seat apparatus form 400 comprises an armrest and a bench.

Referring to FIGS. 8A to 10B, the seat apparatus 400 comprises a base 102, platform 104, seat 106 and a lid 108. The seat 106 is rotatable relative to the base 102. The seat apparatus 400 comprises a swivel plate 120, a locking plate 122 and a bearing 124.

The seat 106 and lid 108 are pivotably coupled to the platform 104. The locking plate 122 is connected to the base 102. The swivel plate 120 is connected to and supports the platform 104 and seat 106. The bearing 124 is a thrust bearing and rotationally connects swivel plate 120 to the locking plate 122. The bearing 124 rotatably connects the seat 106 to the base 102.

The second seat apparatus form 400 comprises a base, locking plate, bearing, swivel plate, seat and lid that is identical to the first seat apparatus form 100 i.e. first seat apparatus configuration. The second seat apparatus form 400 comprises a single armrest 202. The armrest 202 is the second armrest described earlier. The second armrest 202 may be permanently coupled to the swivel plate. Alternatively, the second armrest 202 may be removably coupled to the swivel plate 120. The second armrest 202 is common to both the first seat apparatus form 100 and the second seat apparatus form 400.

The second seat apparatus form 400 comprises a flat bench 402 that is attached to the swivel plate 120. The second seat apparatus form 400 differs from the first seat apparatus form 100 since the second seat apparatus form 400 comprises a bench 402 instead of the first arm rest 200. The seat apparatus is a modular apparatus and comprises a plurality of accessories that are removably attachable to the seat 102. The accessories comprise an armrest and a bench. The accessories being interchangeably attachable to the seat. In use, a first seat apparatus form 100 is created by attaching the first armrest 200 to the seat and the second seat apparatus form 400 created by attaching the bench 402 to the seat.

The seat 106 of the second seat apparatus form 400 is rotatable i.e. swivelable relative to the base 102. The seat 106 can be locked into one or more locked positions relative to the base 102. The second seat apparatus form 400 comprises a second locking assembly to lock the seat relative to the base or unlock the seat relative to the base to allow rotation of the seat.

Figure 9:
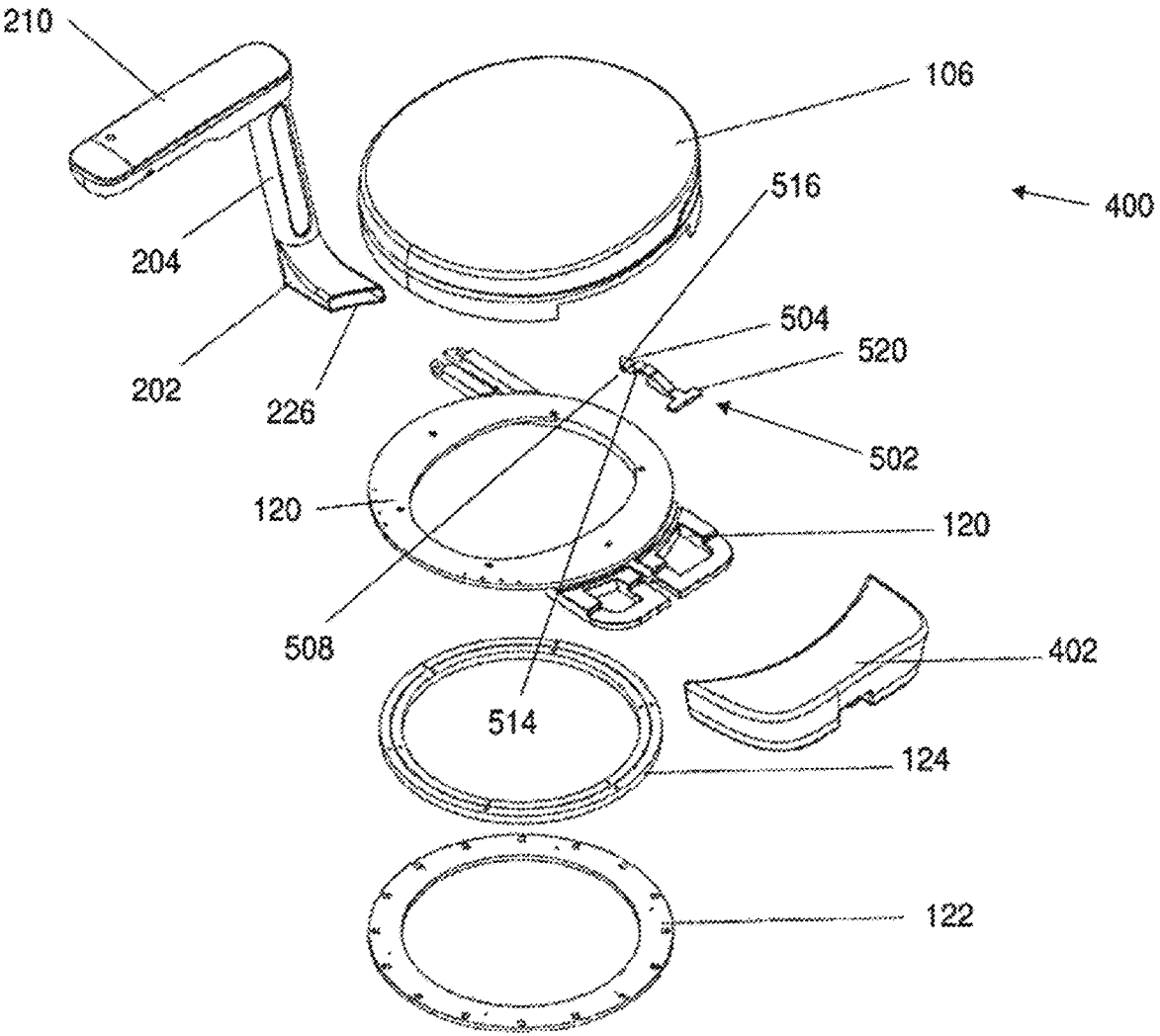
FIG. 9 illustrates an exploded view of the seat apparatus shown in FIGS. 8A and 8B.

FIG. 9 illustrates an exploded view of the second seat apparatus form 400. The bench 402 is removably attached to the swivel plate. The bench 402 comprises a flat, planar slab. The bench 402 may comprise a soft cushion disposed on an upper side of the bench. The bench has curved corners to make the bench 402 more ergonomic. The bench 402 comprises an opening 404 on one side of the slab. A portion of the swivel plate is received into the opening 404. The bench 402 may be attached to the seat by friction fit or may be fastened using one or more fasteners.

As shown in FIG. 9, the swivel plate 120 comprises a first connection projection and a second connection projection 126. The second connection projection 126 is in the same as the connection projection the connection projection in the first seat apparatus form. The first connection projection may be similar in structure to the connection projection 125 as described earlier. In the illustrated form in FIG. 9, the first connection projection 425 may include an additional connecting chassis 426. The chassis 426 may be removably or permanently attached to the first connection projection.

Alternatively, the seat apparatus 400 may comprise a first connection chassis 426 that is removably attachable to the swivel plate 120. The connection chassis 426 is a planar, rectangular shape. The chassis 426 is removably coupled to the swivel plate 120 to allow interchanging by a user between the first and second seat apparatus form. The chassis 426 includes a rectangular outwardly protruding frame that is inserted into the connection opening 404 of the bench to fasten the bench to the swivel plate 120.

The armrest 202 is attached to the second connection projection 126 by one or more fasteners. In the illustrated example the armrest 202 is fastened by two fasteners e.g. screws, similar to the connection shown in FIGS. 11A and 11B. The connection projection 126 is fastened to the strut and stanchion inside the strut of the armrest 202 by two fasteners. The armrest 202 may be removably fastened or may be permanently fastened.

The second seat apparatus form 400 comprises a second locking assembly 500. The second locking assembly comprises a trigger 502, a locking arm 504, a biasing member 506 and a locking peg 508. The trigger 502 comprises a projection. The projection 502 comprises a handle 520. The handle 520 is a flared element. In the illustrated example the handle 510 is shaped like a paddle. The handle 520 is integrally formed at a proximal end 510 of the projection. The second locking assembly 500 comprises a locking arm 504. The distal end 512 of the projection 502 is coupled to a proximal end 514 of a locking arm 504. The projection 502 and the locking arm 504 are removably attached together or may be removably attached to each other. A locking peg 508 is formed at the distal end 516 of the locking arm 504. The biasing member 506 is associated with the handle 520.

The biasing member 506 biases the trigger 502 (i.e. projection) to a latched position. In the latched position the locking peg 508 is received into an opening 110 in the locking plate 122. The trigger 502 is actuated by a user moving the handle 520 to an unlatched position, as shown by arrow 1 and item X. The handle 520 moving to an unlatched position causes the projection 502 to move in an opposing direction to the handle 520, as shown by arrow 2 and item Y in FIG. 10A. The movement of the projection 502 causes the locking arm 504 to pivot about a pivot point along the locking arm. The proximal end 514 of the locking arm 504 moves in the same direction as the distal end 512 of the projection 502 and the distal end 516 of the locking arm 504 moves in an opposing direction to cause the locking peg to move to an unlocked position, as shown by arrow 3 and item Z in FIG. 10A.

Figure 10B:
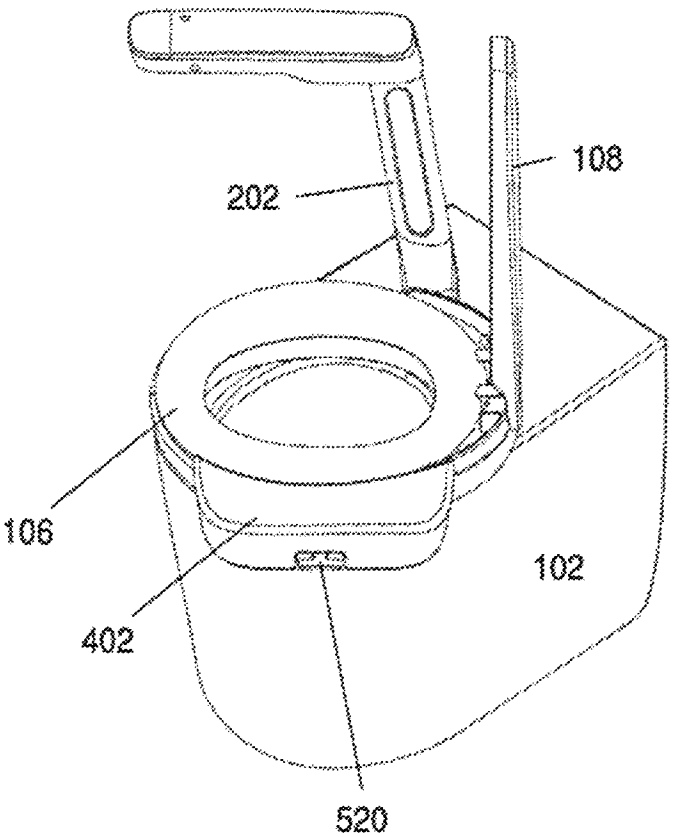
FIGS. 10A and 10B illustrate the operation of the locking apparatus and movement of the second seat apparatus form.
Figure 10A:
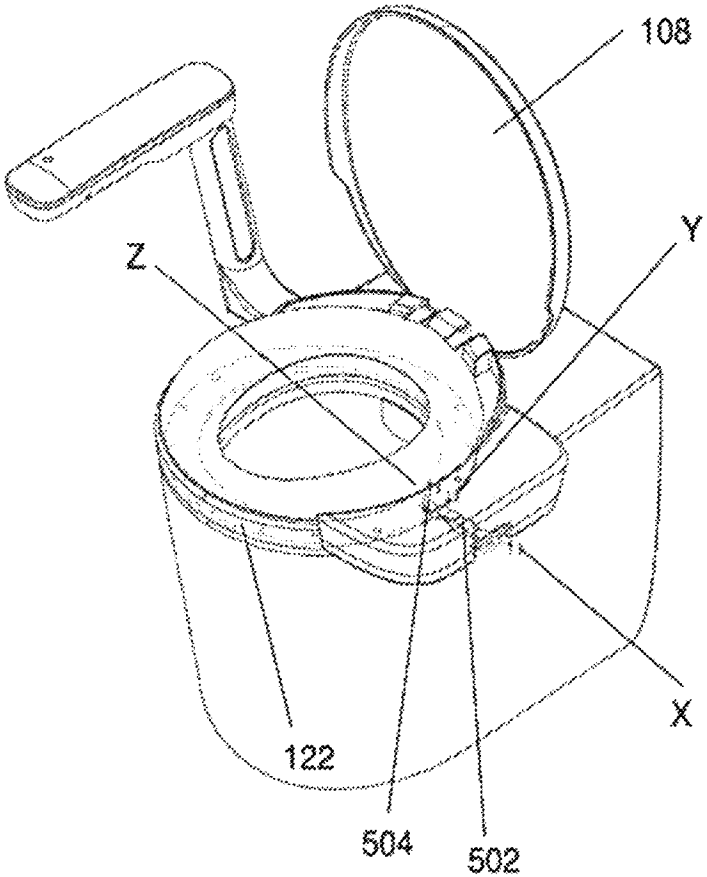

FIG. 10A shows the second seat apparatus form 400 in an operative position i.e. a locked position. The trigger 502 is in the latched position. The seat 106 is locked in position relative to the base 102. In the operative position the locking peg 508 engages a hole in the locking plate to lock the seat relative to the base. The locking plate may comprise a plurality of holes in both forms 100, 400. The plurality of holes corresponding to different positions of the seat (and swivel plate) relative to the base and locking plate.

The handle 520 of the trigger 502 can be lifted upward (i.e. actuated) to an unlatched position to unlock the seat, as per the above description. FIG. 10B shows the seat 106 in a rotated position. The seat 106 may be optionally locked in the rotated position. Alternatively, the seat 106 may freely rotate (i.e. swivel) and only be locked in the operative position.

The seat (of seat apparatus 100, 400) is configured to rotate between 0 and 360 degrees relative to the base. In one example configuration the seat 106 may be configured to rotate positive 90 degrees and negative 90 degrees from the operative position, relative to the base. The seat 106 is configured to be locked at an operative position or at a first locked position or a second locked position, wherein the first locked position corresponds to positive 90 degrees from the operative position and the second locked position corresponds to negative 90 degrees from the operative position. Alternatively, the seat 106 may be locked at one or more positions rotated away from the operative position.

Figure 8A:
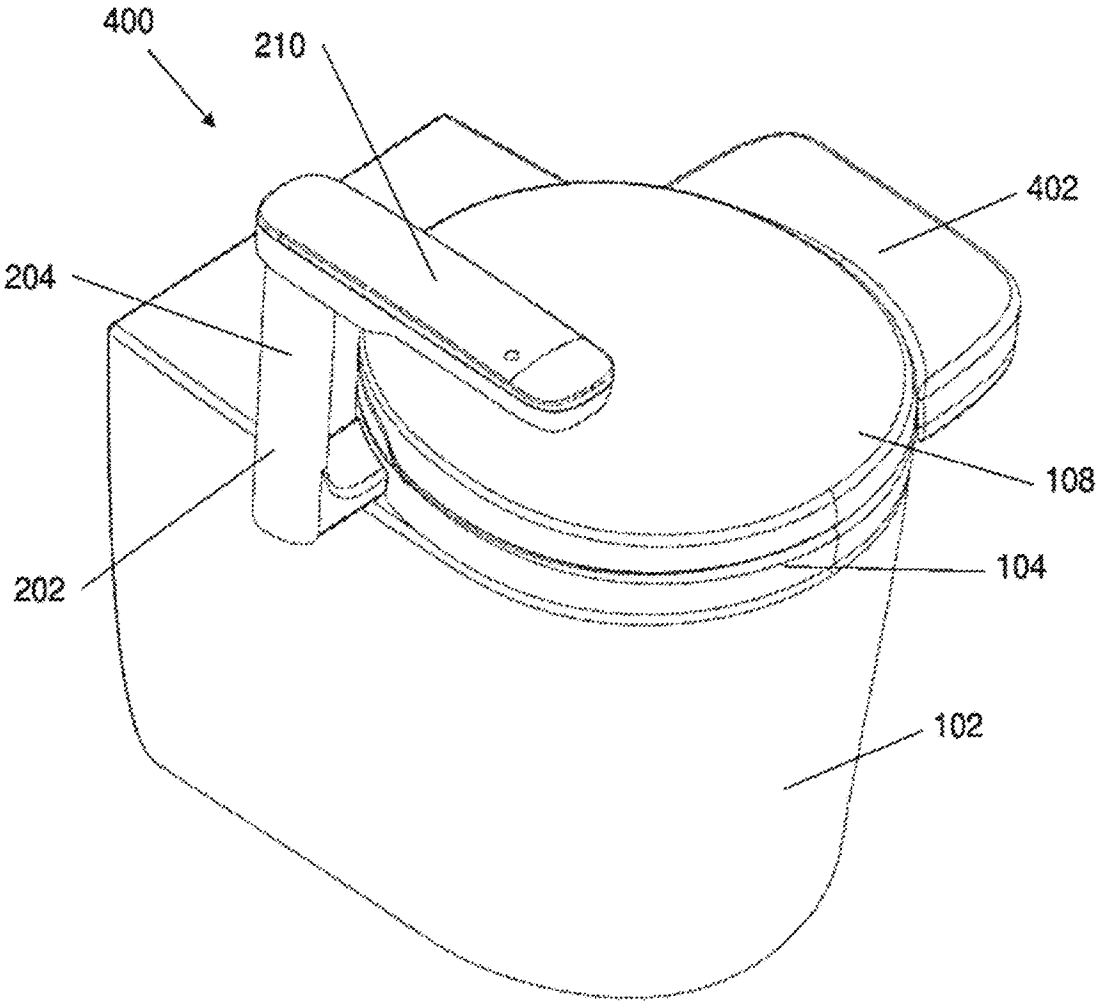
FIGS. 8A and 8B illustrate a perspective view of a second form of a seat apparatus.
Figure 8B:
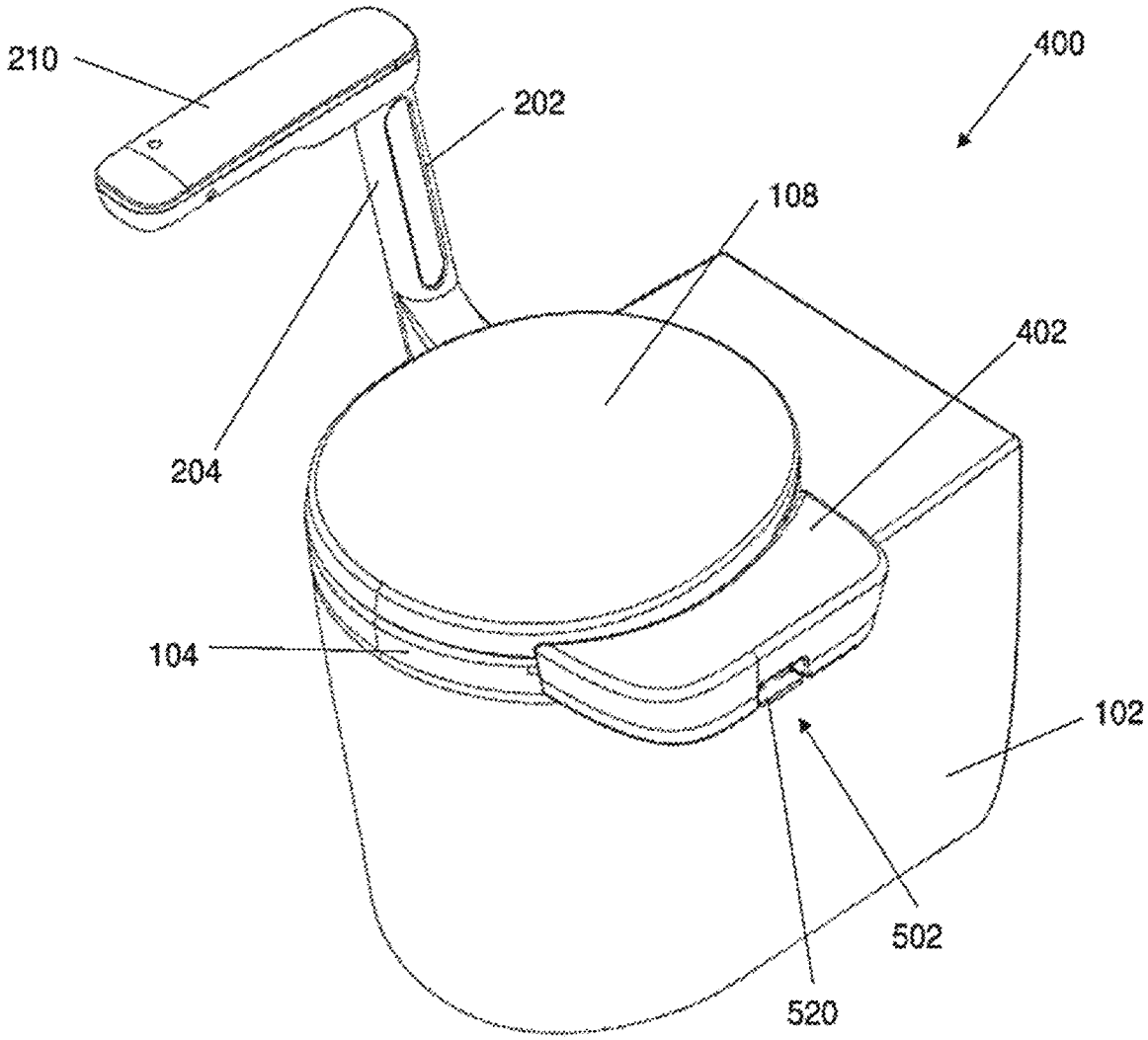

With reference to FIGS. 10C to 10H, there is illustrated another example embodiment of a seat apparatus 400. In this example, the apparatus comprises a base 102, platform 104, seat 106 and a lid 108 as similar to the example embodiment as illustrated in FIG. 8A. In this example, the seat may also be rotatable relative to the base 102 and includes a swivel plate 120, a locking plate 122 and a bearing 124.

As shown, the seat 400 further includes a second armrest 203, which may be arranged to be permanently or removably coupled to the swivel plate 120, platform 104 or seat 106 so as to be rotatable with the seat if it is desired to be rotated into an alternative position by a user.

Figure 10D:
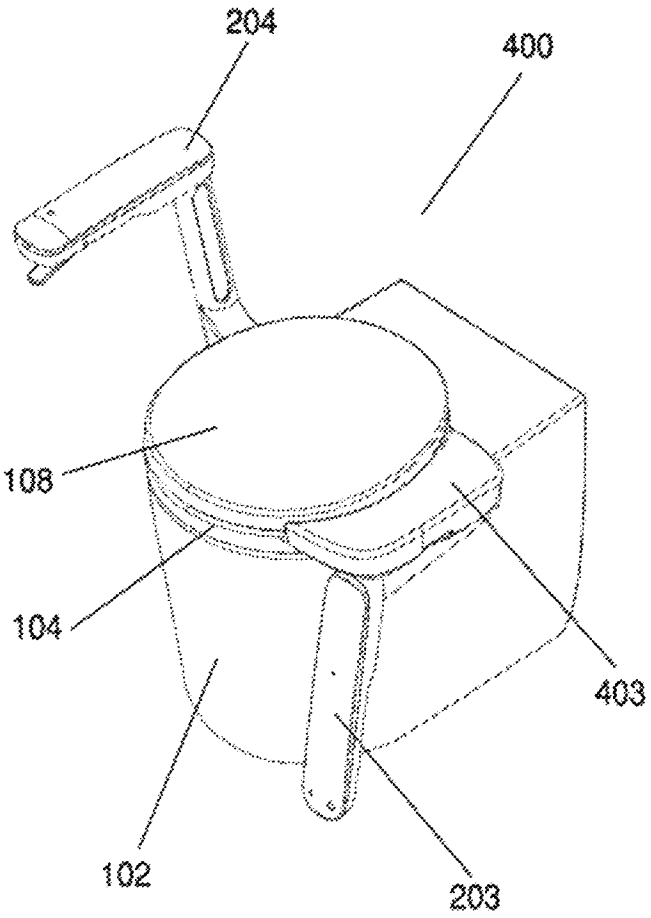
FIG. 10D is a perspective view of the seat apparatus of FIG. 10C with an armrest manipulated into a transfer position.
Figure 10C:
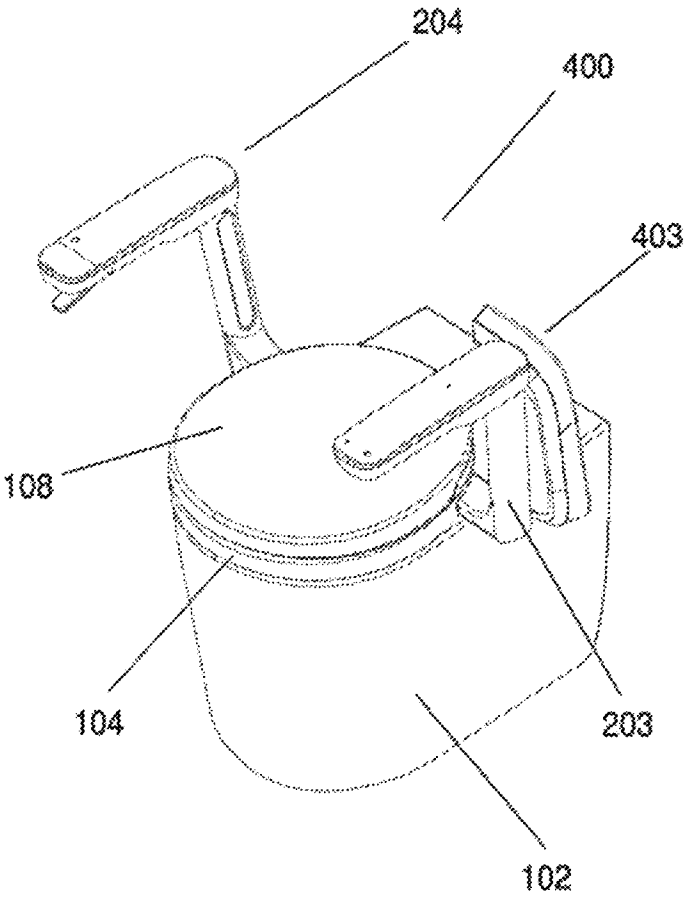
FIG. 10C is a perspective view of an alternative embodiment of the seat apparatus.
Figures 10E, 10F:
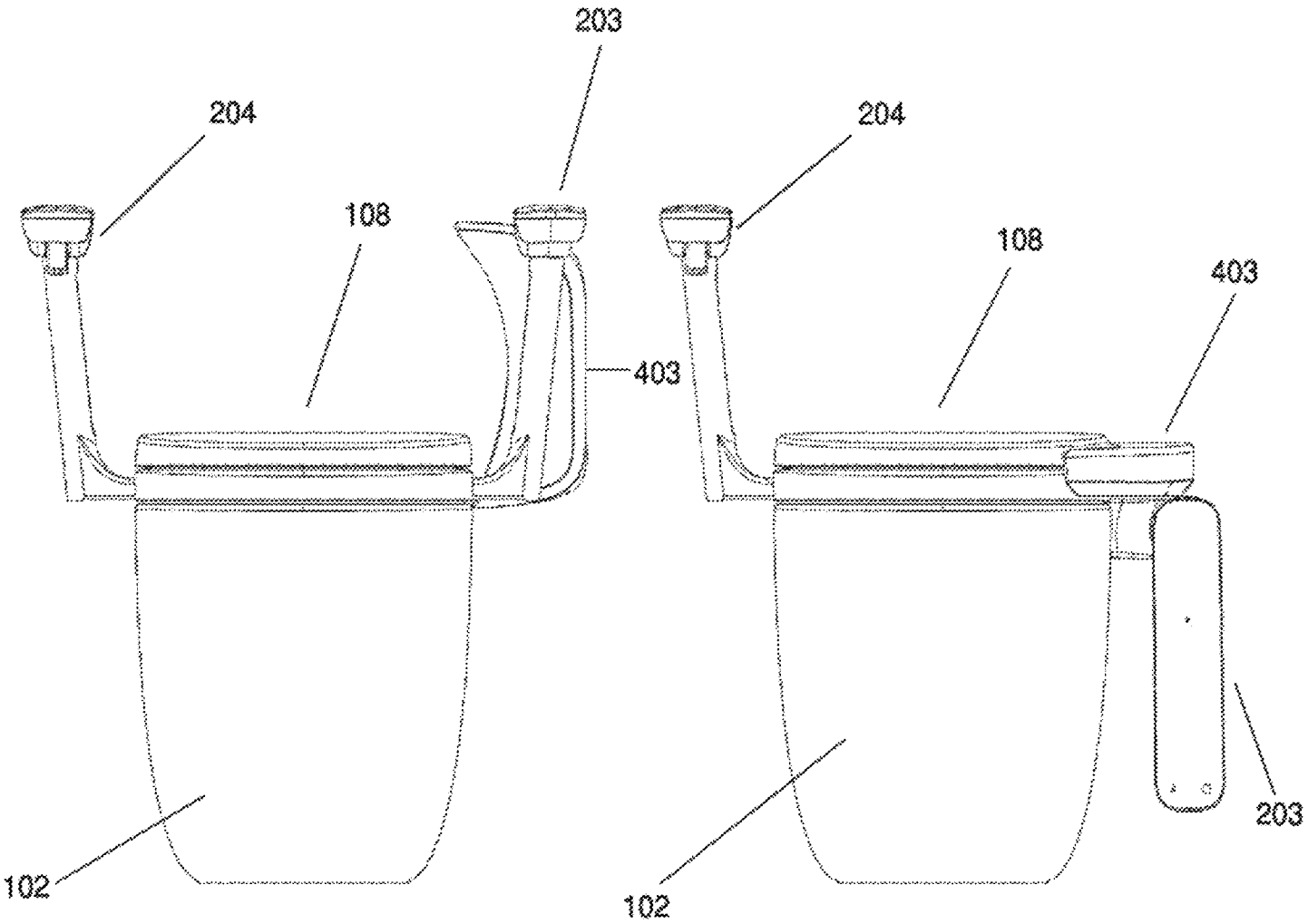
FIG. 10E is a front view of an alternative embodiment of the seat apparatus.
FIG. 10F is a front view of the seat apparatus of FIG. 10E with an armrest manipulated into a transfer position.
Figure 10H:
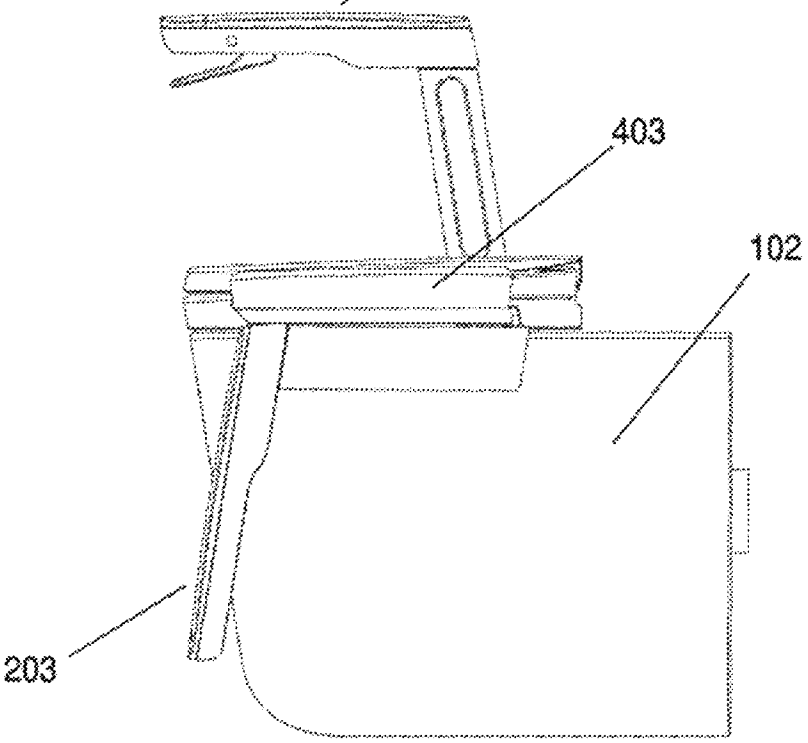
FIG. 10H is a side view of the seat apparatus of FIG. 10G with an armrest manipulated into a transfer position.
Figure 10G:
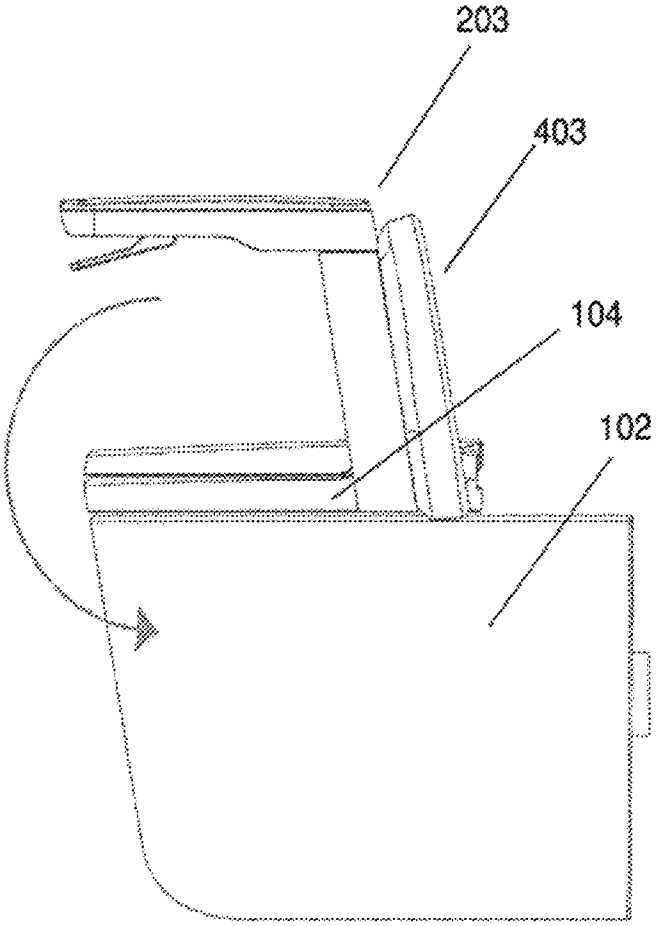
FIG. 10G is a side view of an alternative embodiment of the seat apparatus.

The second armrest 203 includes a bench 403 which is attached to an aft portion of the second armrest 203. In this embodiment, the second armrest 203 is arranged to rotate from an arm supporting position as shown in FIGS. 10C, 10F and 10G in which a user can rest their arms, to a transfer position as shown in FIGS. 10D, 10E and 10H. In the transfer position, the armrest 203 can be rotated towards the base 102 such that the attached bench 403 is rotated into a positon that provides a substantially parallel extension to the seat. In this transport position, the bench 403 effectively functions as the bench 402 of FIGS. 8A and 8B, and provides a platform whereby a user may be able to rest parts of their body in transferring themselves from one stable surface, such as their chair, wheelchair or mobility aid device and onto the seat apparatus 400.

This example embodiment may be advantageous as the seat apparatus 400 may provide two armrests 203 and 204 whilst also providing the presence of a bench 403 surface for the transfer of users from their mobility aids to the seat apparatus 400. The presence of two armrests 203 and 204 provides for more support for a user when seated on the apparatus 400 and by allowing one of the armrests 203 to be rotatable between two positions so as to provide a bench 403, the seat apparatus would retain both the dual armrest arrangement 203, 204 and the bench 403 to enhance the safety and convenience of the seat 400 for the user.

Figure 14A:
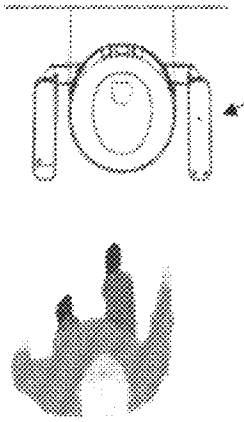
FIGS. 14A-14G illustrate a first form of the seat apparatus being used by an individual with some limited mobility.
Figure 14B:
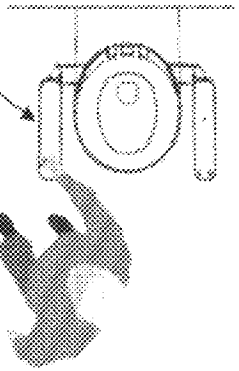
Figure 14C:
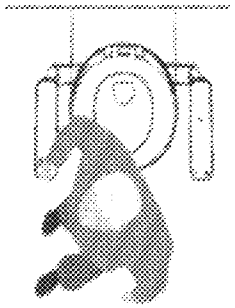
Figure 14D:
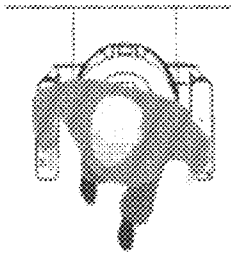
Figure 14E:
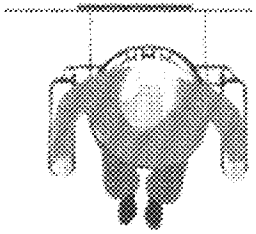
Figure 14F:
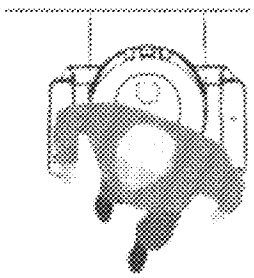
Figure 14G:
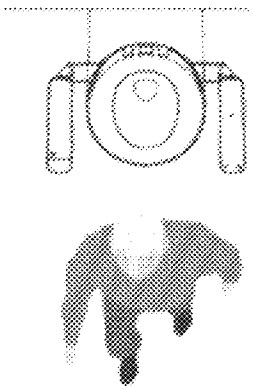

FIGS. 14A to 14G illustrates a first use case of an able bodied individual with slightly limited mobility using the seat apparatus. The seat apparatus is a first form 100 that includes two armrests. In FIG. 14A, the user walks up to the toilet seat 100. The user holds onto the armrest 200 while turning, as shown in FIG. 14B. FIG. 14C shows the user continues to turn their body while leaning on the armrest with their body weight. The armrest 200 is rigidly attached to the swivel plate and seat by the fasteners. The swivel plate and seat are locked in place by the locking assembly therefore the users weight is transferred to the base. This rigidly locked seat allows the armrest to bear the load of the user. FIG. 14D shows the user sits down on the seat while using the armrests 200, 202 to support the user's weight. The seat apparatus is sturdy and robust and can bear the weight due to the locking assembly 300 rigidly locking the seat to the base. The user uses the toilet in FIG. 14E. The user gets up off the seat while bearing on the armrests 200, 202 as shown in FIG. 14F. In FIG. 14G the user walks away.

FIGS. 15A to 15H illustrates the first form seat apparatus 100 being used by a partially paralyzed user. A partially paralyzed user has limited mobility in their body and so can find it difficult to turn around and back onto a conventional toilet. The seat apparatus 100 used as a toilet seat provides one way for a user to use the toilet. FIG. 15A shows a user approaching the toilet 100. FIG. 15B shows the user actuating the trigger 302 to unlock the seat 106 from the base 102. The user keeps the trigger 302 actuated and rotates the seat to a rotated position away from the operative position, as shown in FIG. 15C. The seat 106 is rotated in a negative direction i.e. in a negative arc from the operative position. The user releases the trigger 302 to lock the seat at negative 90 degrees from the operative position, as shown in FIG. 15D. The user holds the armrest and sits down by bearing onto the armrest 202, as shown in FIG. 15D. The user actuates the trigger 302 to unlock the seat 106 and rotate the seat back to the operative position, as shown in FIG. 15E. FIG. 15F shows the seat 106 being locked in an operative position for a user to use the toilet. FIG. 15G shows the user being able to get off by pushing against and bearing down onto the armrest 202. The seat 106 is locked by the locking assembly so provides a stable platform for the user to lean against. FIG. 15H shows the user exits the toilet.

The seat apparatus usage as shown in FIGS. 15A to 15H is advantageous because it allows a person with limited mobility to sit on the toilet without having to make complex manoeuvres. The seat is rotated to prevent the user having to turn and potentially cause pain. The user can sit down and rotate the seat back to an operative position. The operative position aligns with an exit of the toilet and therefore allows a user to get up and walk out. The seat being locked in place by the locking assembly provides a stable platform for the user to lean against.

FIGS. 16A to 16F show a use scenario for a wheelchair bound user i.e. a physically disabled user. As shown in FIGS. 16A to 16F the second seat apparatus form 400 is used by a wheelchair bound user. The seat apparatus may be changed from the first form 100 to the second form 400 for a wheelchair user. The second form 400 of the seat apparatus comprises a bench and a second locking assembly. The trigger is integrated into the bench. As shown in FIG. 16A, the user rolls into the toilet and approaches the seat 106. The user can actuate the trigger 502 from beneath the bench 402 to rotate the seat as shown in FIG. 16B. The user holds the trigger to rotate the seat as shown in FIG. 16C. The seat is rotated to a position that is negative 90 degrees and is locked in place by releasing the trigger as shown in FIG. 16D. The user can be transferred onto the seat 106 by using the bench 402, as shown in FIG. 16D. The bench 402 is used as a transfer board to transfer a wheelchair bound user onto the seat 106. FIG. 16E shows the user actuating the trigger 502 to unlock the seat 106 and rotate the seat back to an operative position. The operative position for the seat apparatus is 0 degrees i.e. forward facing. FIG. 16F shows the seat being locked in the operative position by the locking assembly so the user can use the toilet. The order is reverse to allow the user to transfer back onto their wheelchair and get off the toilet.

The seat apparatus is interchangeable between a first form 100 and a second form 400. The seat apparatus is a modular assembly that comprises a plurality of interchangeable accessories to change the form of the seat apparatus. The first armrest 202 and the bench are removable accessories. The first armrest 202 including a first locking assembly 300 and the bench 402 comprising the second assembly are interchangeable accessories. Depending on the type of user the one of the accessories can be attached to the seat apparatus. This is advantageous because it allows the seat apparatus to be used with a wide variety of users such as for example able bodied users, partially paralyzed users, users with limited mobility and paralyzed or wheelchair bound or disabled users. The interchangeable accessories allow for a single seat apparatus to be used for a wide range of users.

The seat apparatus as described herein i.e. both forms of seat apparatus 100, 400 are also advantageous because they provide a rotatable (i.e. swivelable) seat. The seat can be rotated about the base to allow for use in tight spaces. The seat is configured to be locked in an operative position using a locking assembly to ensure safe usage of the seat. In the illustrated example the seat can be locked in the operative position to allow a user to use the toilet without falling or being unstable.

The rotatable seat makes the seat apparatus useful as a toilet because the seat can be swivelled to allow a user to easily and safely get on and off the toilet in tight spaces or confined spaces. Users with limited mobility or partial paralysis or elderly users often find it difficult to use a normal fixed toilet since these users cannot turn their hips and sit on the toilet. Further toilets often are positioned in tight spaces where there is little room to manoeuvre the body of users with limited mobility. The currently described rotatable and lockable seat is advantageous because a user can unlock the seat using the locking assembly and rotate the seat to a desired orientation to make it easy for the user to sit. Once on the seat the user can rotate it back to the operative position and lock the seat to use the toilet. The seat can be unlocked and swiveled to allow a user to alight from the seat. The locking mechanisms 300, 500 described herein are advantageous because they mechanically lock the seat to the base. This provides a sturdy platform for a user to lean on and bear weight thereon such that the user can sit and get off the seat. The locking assembly creates a secure lock such that the seat apparatus is sturdy enough to carry the weight of the user, thereby making it easier for the user to get on and off. The sturdy locked configuration also reduces the weight a user has to support thereby making the seat apparatus easier and more pleasant to use.

The seat apparatus 100, 400 as described herein is a toilet. A similar construction as described herein could be applied to other seats or seat apparatus for use in bathrooms e.g. a shower chair. A shower chair may comprise a base and a rotatable seat. The seat would comprise a rotation mechanism as described earlier. The rotation mechanism comprises the swivel plate, locking plate, bearing (e.g. thrust bearing) and the locking assembly as described herein to lock the swivel plate relative to the locking plate. The rotation mechanism can be used in other applications and other seats that would be used in tight spaces to allow easier access and easier use for physically disabled or partially immobile users.

In some embodiments, the seat apparatus 100, 400 may be implemented to include additional electrical, mechanical or electronic devices, sensors of apparatus so as to enhance the seat apparatus's functionality. Examples of such devices, sensors or apparatus may include pumps for the delivery of water or air for cleaning, massage or temperature adjustment purposes. The seat apparatus 100, 400 may also be implemented with sensors to monitor and detect health or physical conditions of the user, including temperature, weight, time spent on the seat as well as pressure exerted onto the seat when the user mounts or dismount from thereof. Such data may be stored or communicated to a device for further analysis or processing, or alternatively, it may provide additional functions, such as the heating or cooling of the seat apparatus 100, 400, or instruct a central air conditioning system to warm or cool the environment, or to keep track of the user's usage of the toilet.

Such example sensors, devices and apparatus may be implemented on the seating apparatus 100, 400, or only partially implemented on the seating apparatus, with other components being implemented in other components or elsewhere remote from the seating apparatus 100, 400. In some embodiments, the seating apparatus may include a dedicated component, such as a sensor housing 330, configured to accomodate or support such senors. The location or position of implementation can vary provided the sensors, devices and apparatuses are able to communicate to provide a specific function for the user.

The foregoing describes some example embodiment (or embodiments) of the present invention and modifications, obvious to those skilled in the art, can be made thereto without departing from the scope of the present invention. While the invention has been described with reference to the example embodiments it should be appreciated that the invention can be embodied in many other forms.

Reference to any prior art in this specification is not, and should not be taken as, an acknowledgement or any form of suggestion that the prior art forms part of the common general knowledge in the field of endeavor in any country in the world.

Although the present disclosure has been described in terms of certain embodiments, other embodiments apparent to those of ordinary skill in the art also are within the scope of this disclosure. Thus, various changes and modifications may be made without departing from the spirit and scope of the disclosure. For instance, various components may be repositioned as desired. Features from any of the described embodiments may be combined with each other and/or an apparatus may comprise one, more, or all of the features of the above described embodiments. Moreover, not all of the features, aspects and advantages are necessarily required to practice the present disclosure. Accordingly, the scope of the present disclosure is intended to be defined only by the claims that follow.

The various configurations or embodiments described are exemplary configurations only. Any one or more features from any of the configurations may be used in combination with any one or more features from any of the other configurations.

What is claimed is:

1. A seat apparatus comprising:

a base;

a seat, wherein the seat is moveably-connected to the base such that the seat is rotatable relative to the base, a rotation mechanism, comprising:

a first locking assembly associated with the seat, the first locking assembly is configured to lock the seat in one or more positions relative to the base, wherein the first locking assembly comprises a trigger that is manually-actuable by a user;

a locking plate attached to the base, where the locking plate comprises a plurality of apertures:

a swivel plate rotatable relative to the locking plate; and a bearing positioned between the locking plate and the swivel plate, the bearing is rotatably-coupled the swivel plate to the locking plate such that the seat can rotate relative to the base; and a first armrest connected to a lateral side of the seat, wherein the first armrest comprises a support member and a vertical strut that is connected to and holds up the support member, the vertical strut is coupled to the swivel plate, and the trigger is positioned on or within the first armrest, wherein the trigger is mounted within a housing of the support member, and the first locking assembly is extended through a hollow tube of the vertical strut, wherein the seat is rotatable between an operative position and one or more other rotated positions, and the seat is lockable at the operative position and the one or more rotated positions by the locking assembly, wherein the seat is unlocked when the trigger is actuated, to allow the seat to rotate relative to the base.

2. The seat apparatus in accordance with claim 1, wherein the seat apparatus further comprises a platform and a lid, where the platform is couple to the swivel plate, and the lid and the seat are pivotably-coupled to the platform such that the seat and/or the lid is able to pivot relative to the platform.

3. The seat apparatus in accordance with claim 2, wherein the seat is pivotable between the operative position where the seat rests on the platform and a stowed position where the seat is lifted up and away from the platform, and; the lid is pivotable between a closed position where the lid rests on the seat to cover the seat and an open position where the lid is pivoted away from the seat.

4. The seat apparatus in accordance with claim 1, wherein the first locking assembly further comprising:

a locking peg in mechanical communication with the trigger, wherein the locking peg is biased toward a locked position to lock the seat relative to the base and the locking peg is moved to an unlocked position when the trigger is actuated;

a locking arm mechanically-coupled to the trigger, wherein the locking peg extends outwardly from the locking arm, and the locking arm is moveable to cause the locking peg to move between the locked position and the unlocked position;

a link arm, wherein a distal end of the link arm is coupled to a proximal end of the locking arm and the locking peg is disposed at a distal end of the locking arm, the link arm is connected to the locking arm and the trigger, and the link arm moves in response to actuation of the trigger and thereby moving the locking arm and the locking peg;

a cable, wherein a first end of the cable is connected to the trigger and a second end of the cable is connected to a proximal end of the link arm, and the distal end of the link arm is coupled to the proximal end of the locking arm and the locking peg is disposed at the distal end of the locking arm, wherein in use, actuating the trigger creates a pull force on the cable and causes the cable to be pulled, and pulled cable causes the link arm and the locking arm to move, thereby causing the locking peg to move from the locked position to the unlocked position such that the locking peg is disengaged from apertures in the locking plate, and;

in use, when the trigger is released, the pull force is removed and causes the cable to move away from the trigger, the movement of the trigger causes the link arm and the locking arm to move, thereby causing the locking peg to move to the locked position from the unlocked position such that the locking peg engages the apertures in the locking plate.

5. The seat apparatus in accordance with claim 4, wherein each aperture corresponds to a position of the seat relative to the base, and each aperture is sized and shaped to receive the locking peg into the apertures.

6. The seat apparatus in accordance with claim 4, wherein the trigger comprising:

an actuating lever pivotable between a latching position and an unlatching position, and pivoted actuating lever is pivoted from the latching position to the unlatching position and causes the locking peg to move from the locked position to the unlocked position; and a lever housing, wherein the actuating lever is fitted within the lever housing, wherein the lever housing is located within the housing of the support member.

7. The seat apparatus in accordance with claim 6, wherein the support member of the first armrest further comprising:

a lid;

a container, the container comprises an access opening, and a frame with a trigger mount disposed within the container;

an elongate stanchion positioned within a hollow tube of the vertical strut, wherein the elongate stanchion comprises a connection end, a support end, and one or more holes located at the connection end;

a biasing member mounted at or adjacent the trigger mount, the biasing member biases the actuating lever toward the latching position, wherein the lever housing is mounted to the trigger mount so that a portion of the actuating lever extends through an access opening to allow the user to access and actuate the actuating lever.

8. The seat apparatus in accordance with claim 7, wherein the swivel plate comprises a connection projection, the connection projection is removably-fastened to the elongate stanchion at the connection end by one or more fasteners.

9. The seat apparatus in accordance with claim 7, wherein the cable extends from the actuating lever through a housing of the first armrest, through the hollow tube of the vertical strut, and connects to the link arm, the link arm and the locking arm are disposed within the vertical strut adjacent to a connecting end of the vertical strut.

10. The seat apparatus in accordance with claim 7, further comprising a tension adjuster located within the hollow tube of the vertical strut, and a cable lock disposed within the container, the cable passes through the cable lock and the tension adjuster, and the cable lock is configured to lock the cable from movement when the actuating lever is in the latching position and unlock the cable to allow the cable to move relative to the first armrest when the actuating lever is actuated to the unlatching position.

11. The seat apparatus in accordance with claim 1, further comprising an accessory having a second locking assembly removably-coupled to the swivel plate, wherein the accessory is selected from a group consisting of a second armrest, and a bench.

12. The seat apparatus in accordance with claim 11, wherein the second locking assembly comprises a trigger, a locking arm mechanically-coupled to the trigger and a locking peg located on the locking arm;

the trigger comprises a projection, the projection includes a handle formed at a proximal end, a distal end of the projection is coupled to a proximal end of the locking arm and the locking peg is attached to or integrally-formed at a distal end of the locking arm;

the trigger is actuated by the user who moves the handle to the unlatching position, causing the projection to move in an opposing direction to the handle, the movement of the projection causes the locking arm to pivot about a pivot point along the locking arm.

13. The seat apparatus in accordance with claim 12, wherein the proximal end of the locking arm moves in the same direction as the distal end of the projection and the distal end of the locking arm moves in an opposing direction to cause the locking peg to move to the unlocked position.

14. The seat apparatus in accordance with claim 11, wherein the swivel plate comprises a first connection projection and a second connection projection, the first connection projection and the second connection projection extend outwardly from the swivel plate in opposing directions.

15. The seat apparatus in accordance with claim 13, wherein the locking arm is moved to cause the locking peg to disengage from the apertures in the locking plate or to engage the apertures in the locking plate, wherein in use, actuating the trigger causes the trigger to mechanically-move the locking arm and thereby causing the locking peg to disengage from the apertures in the locking plate such that the swivel plate and the seat is able to rotate relative to the base, and wherein the locking peg is located at one end of the locking arm and the locking peg is attached to the locking arm or integrally-formed with the locking arm.

16. The seat apparatus in accordance with claim 1, wherein the seat is configured to rotate between 0 and 360 degrees relative to the base.

17. The seat apparatus in accordance with claim 16, wherein the seat is configured to be locked at the operative position or at a first locked position or a second locked position, wherein the first locked position corresponds to positive 90 degrees from the operative position and the second locked position corresponds to negative 90 degrees from the operative position.

18. The seat apparatus in accordance with claim 1, wherein the seat apparatus is a modular toilet seat or a shower chair.

* * * * *